US006981888B2

(12) United States Patent
O'Keefe et al.

(10) Patent No.: US 6,981,888 B2
(45) Date of Patent: Jan. 3, 2006

(54) LOCKABLE ELECTRIC POWER CORD ADAPTER

(75) Inventors: Michael O'Keefe, Paso Robles, CA (US); Michael Mueller, Suwanee, GA (US); John Witzigreuter, Kennesaw, GA (US)

(73) Assignee: Piranha Plugs, LLC, Marietta, GA (US)

( * ) Notice: Subject to any disclaimer, the term of this patent is extended or adjusted under 35 U.S.C. 154(b) by 0 days.

(21) Appl. No.: 11/053,303

(22) Filed: Feb. 8, 2005

(65) Prior Publication Data

US 2005/0153592 A1 Jul. 14, 2005

Related U.S. Application Data

(62) Division of application No. 10/881,918, filed on Jun. 30, 2004, now Pat. No. 6,875,040.

(60) Provisional application No. 60/535,243, filed on Jan. 9, 2004.

(51) Int. Cl.
*H01R 13/62* (2006.01)

(52) U.S. Cl. ..... 439/369

(58) Field of Classification Search ..... 439/368, 439/369, 370, 371
See application file for complete search history.

(56) References Cited

U.S. PATENT DOCUMENTS

| | | | | | |
|---|---|---|---|---|---|
| 2,913,791 | A * | 11/1959 | Martin | 24/136 R |
| 3,613,046 | A * | 10/1971 | Kirk | 439/369 |
| 4,097,105 | A * | 6/1978 | Zumwalt | 439/369 |
| 4,925,399 | A * | 5/1990 | Bosworth et al. | 439/370 |
| 5,766,032 | A * | 6/1998 | LaPointe et al. | 439/371 |
| 6,699,058 | B1 * | 3/2004 | Estrela et al. | 439/346 |
| 2003/0157826 | A1 * | 8/2003 | Moreno et al. | 439/369 |

* cited by examiner

*Primary Examiner*—Tho D. Ta
(74) *Attorney, Agent, or Firm*—David P. Kelley

(57) ABSTRACT

A lockable electric power cord adapter has a unitary housing containing male plug blade receiving member therein wherein each blade receiving member has a pivotable locking member mounted thereon. The blade receiving member has a hole therein for allowing a barbed end of the locking member to pass therethrough and engage a hole in the male plug blade in the locking position. An actuator has actuating lugs thereon which pivot the locking members to an unlocked position when the actuating member is pushed against a biasing spring.

11 Claims, 26 Drawing Sheets

LOCKABLE ELECTRIC POWER CORD ADAPTER

RELATED APPLICATIONS

This application is a divisional application claiming priority to application Ser. No. 10/881,918, filed Jun. 30, 2004, U.S. Pat. No. 6,875,040, which claims priority to U.S. Provisional Application Ser. No. 60/535,243, filed Jan. 9, 2004.

FIELD OF THE INVENTION

This invention relates to electrical power connectors and more particularly, to an adapter for receiving and locking to a male electrical power plug.

BACKGROUND OF THE INVENTION

In conventional North American electrical connectors, a female plug receptacle is designed or adapted to receive a male plug having two straight prongs, and, usually, a grounding pin. The male plug prong may be polarized, in accordance with standard practice, or they may be of the same size.

When such a connection is made, there exists the possibility that, when longitudinal stress is applied thereto, the male and female connectors may disconnect. This is especially true where one of the connectors, usually the female, is one end of an extension cord, or where, for example, the cord is an elongated attachment to a power tool and is terminated by a male plug. In such case, the disconnect is a nuisance at the very least, and potentially dangerous where power to the tool or other device is essential. Thus, for example, if the powered equipment is a hedge trimmer or lawn mower, it is necessary to stop the work to make a re-connect to the power source, which is usually terminated at its cord end with a female plug. In some cases, the disconnect may not be complete, and the prongs are slightly bared but power is still being transmitted, a real danger of electric shock can be created, especially where the grass or ground is damp.

It has been recognized in the prior art that these problems exist, and numerous arrangements have been proposed for overcoming them, substantially all such arrangements having a locking mechanism for locking the power source cord, usually terminated in a standard female connector to the power receiving tool or cord, terminated in a male connection. The standard North American male plug connector has, as pointed out hereinbefore, two flat, parallel blades, each of which has a small diameter hole spaced from the plug face at a set distance, or a small range of distance. It is a feature of most of the prior art arrangements that some means is provided for anchoring the female member terminating the power source cord to one or both of the holes.

In U.S. Pat. No. 5,921,797 of Forrester such an arrangement is shown wherein the female plug includes a mechanism for locking the connectors together by releasably engaging the holes in the male member blades. The female portion of the connector comprises a two part housing and a cap therefor which is bolted to the housing, with movable actuating and locking collars between the cap and the housing. The assembly is quite complex, with an extremely large member of individual parts, at least ten of which are movable in connecting and disconnecting the male plug therefrom. The extensive list of parts requires columns 2, 3, and 4 of the patent, and serves to emphasize the complexity of the structure.

There are numerous other prior art arrangements which depend upon engagement of the holes in the male prongs to lock the male plug to the female receptacle. See, for example, U.S. Pat. Nos. 4,319,797 of Qtaui et al., 4,932,886 of Glaser, and 5,286,213 of Altergott et al. In most prior art mechanism, the female plug terminating the power cord itself has the locking mechanism therein, and thus the arrangement is not adaptable to other power cord arrangements, such as connection of an extension cord between the power source cord and the cord of the power consuming mechanism or tool.

SUMMARY OF THE INVENTION

The principles and features of the present invention are illustrated hereinafter as used in a North American type assembly. It is to be understood, however, that other types of plugs, such as continental, may be adapted to use these principles and features.

The present invention is, basically, an adapter having a unitary, hollow housing and a cap therefor, mounted on one end of the housing, wherein the cap is a female member for receiving a male plug such as that connected to a tool, and the other end of the housing has extending therefrom male blade members, including a grounding prong, for attachment to the female terminated power cord.

Within the housing are mounted first and second blade receiving members for receiving the blades of the male connector. Pivotally mounted on each of the blade receiving members is a locking member having a barbed end which is adapted to pass through an opening in one side of the blade receiving member and engage the hole in the male member blade. An actuator which is mounted in a slot in the housing and has an external surface for hand or thumb actuation to slide the member rearwardly from its normal spring biased position. The actuating member has first and second spaced lugs thereon, each of which is adapted to engage a surface or edge of one of the pivotable members. The surface to be engaged has a sloped portion and a stop member. When the actuating member is in its normal, spring biased position, the lugs thereof engage the stop members to hold the locking members in the blade engaging locked position, with the spring maintaining the engagement. When the actuating member is manually pushed toward the rear, the lugs thereon engage the sloped surfaces and cam the pivotable locking members into an open or unlocked position, permitting removal of the male plug. When released, the actuator moves back due to the spring force and hence against the stops on the locking members, holding them, by spring force alone, in a closed or locking position.

It can be seen from the foregoing that the locking adapter is quite simple, having only three moving parts as compared to the large number of parts in, for example, the Forrester '799 patent. Further, for that reason, the adapter of the invention can be quickly and quite easily assembled and disassembled.

The basic adapter, as just described, can be adapted to be a female cord termination by removing the standard ferrule plug from the cord, stripping the wires and connecting them as by soldering to the male blades which project from the end of the adapter, and encasing the connections in a plastic cover. The adapter has first and second bosses, one on either side, having openings therein for receiving plastic or other suitable material straps which extend rearwardly. A split collar is mounted on the cord and has a split insert which bears against the distal end of the plastic cover and has slits therein for receiving the straps. A bolt is used to tighten the split cover and the insert, thereby gripping the straps extending therebetween. With this arrangement, the connections are protected from external stresses and the adapter remains firmly mounted to the power cord.

In still another embodiment, instead of the straps, the connections of the cord to the adapter are completely encased in a plastic, or other suitable material, overmolded casing, thereby mounting the adapter permanently to the cord.

These and other features and principals of the invention will be more readily apparent from the following detailed description, read in conjunction with the drawings.

DETAILED DESCRIPTION

Figure 1A:
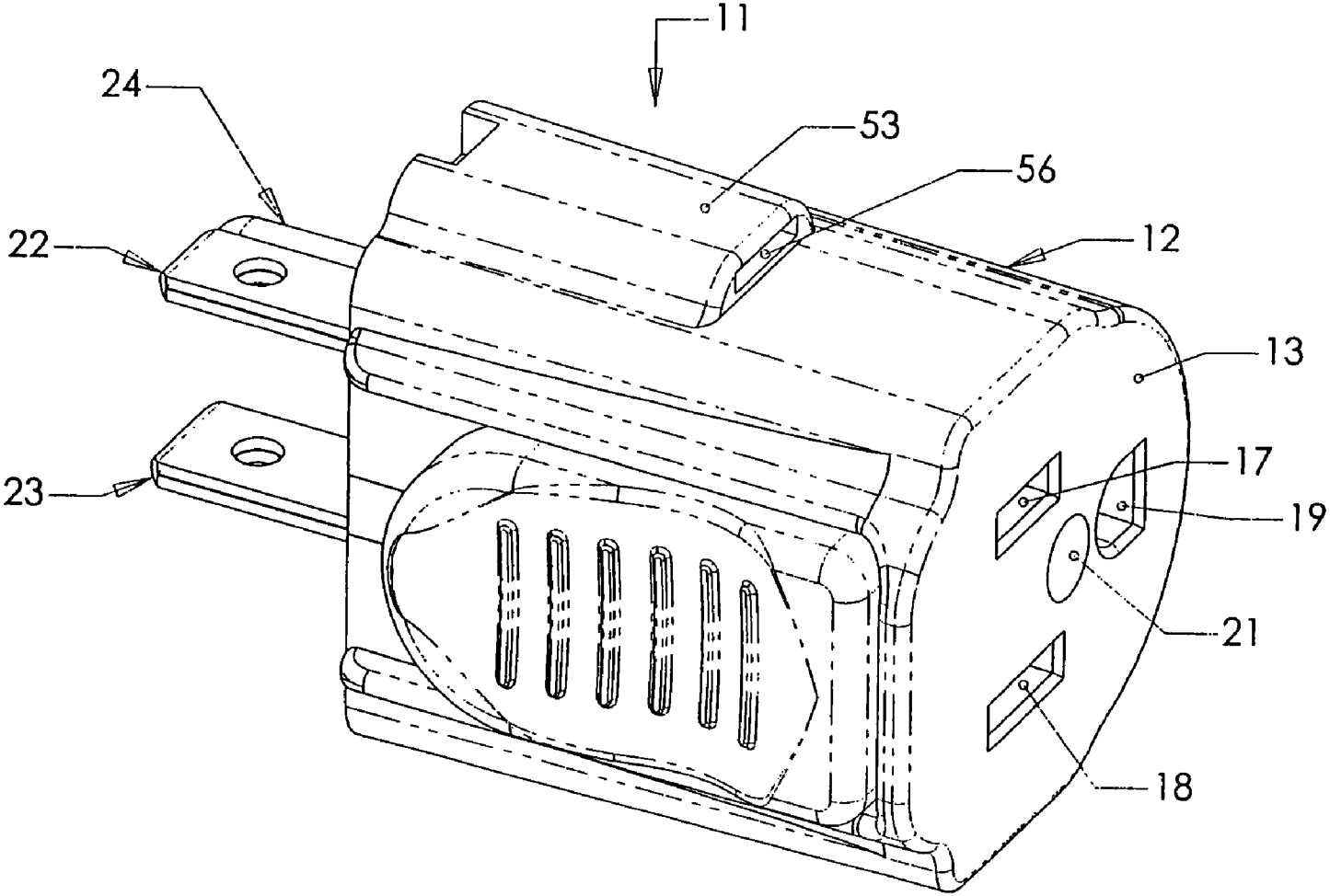
FIGS. 1*a* and 1*b* are perspective views of the locking adapter of the present invention
Figure 1B:
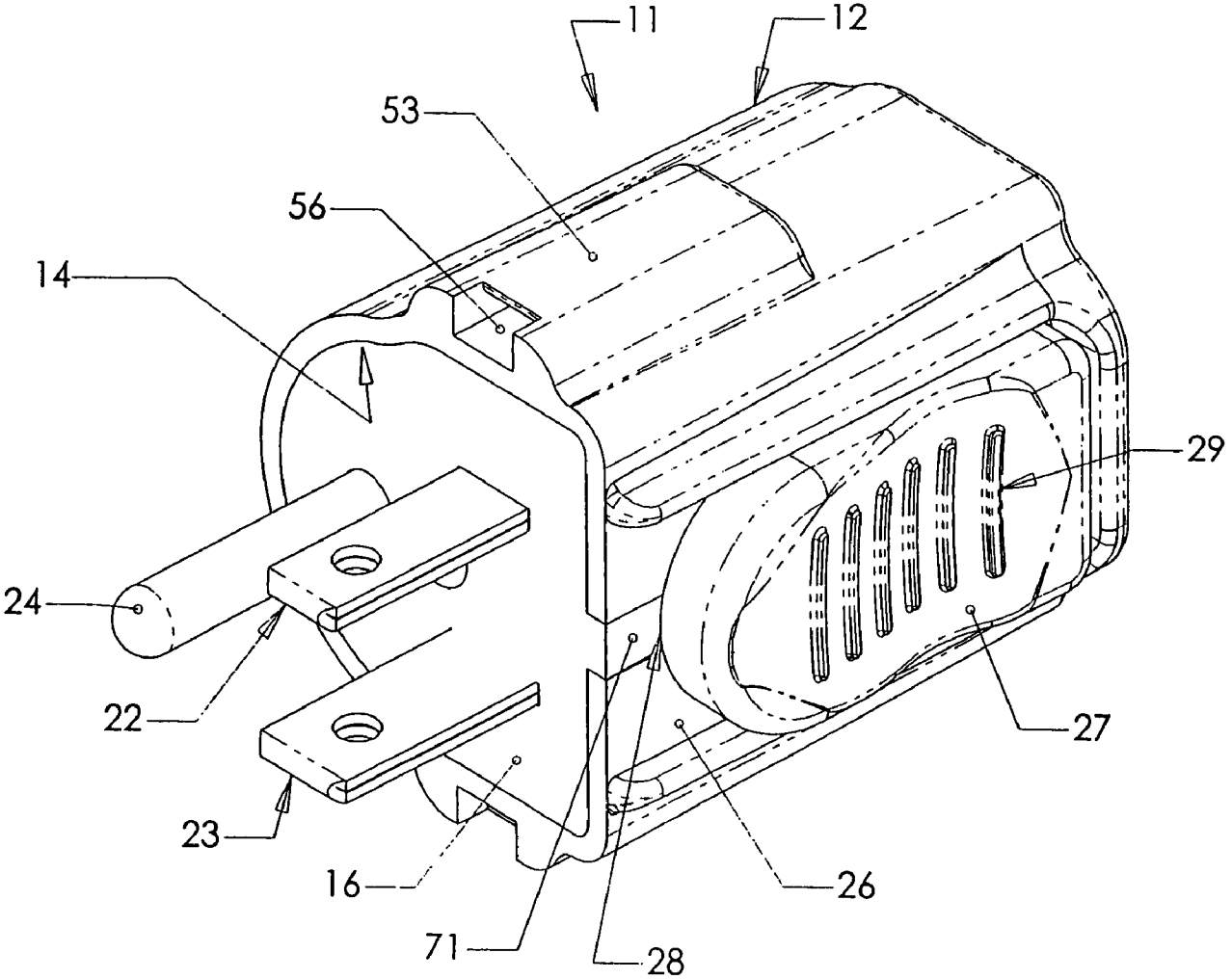
Figure 2A:
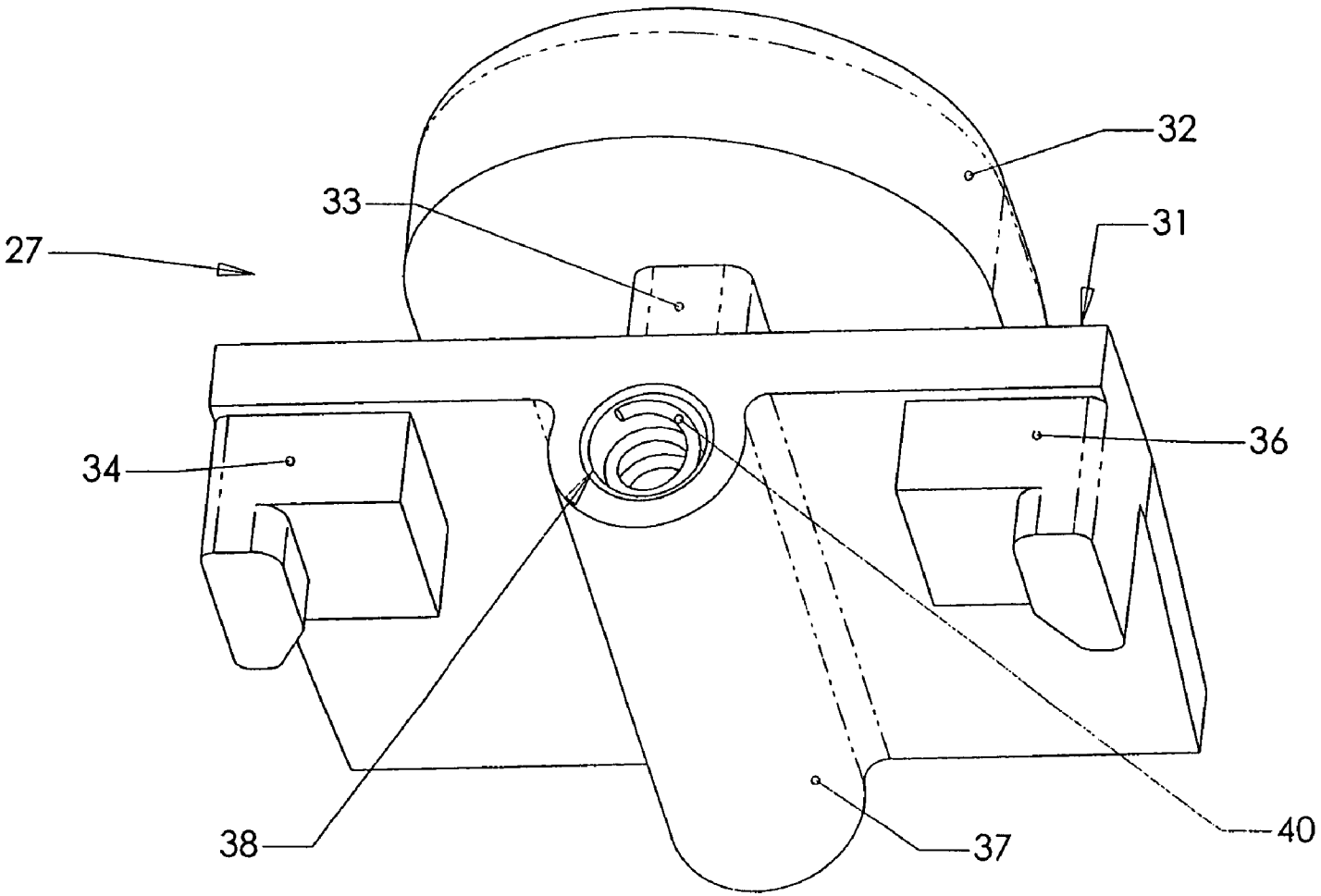
FIGS. 2*a*, 2*b*, 2*c*, and 2*d* are, respectively; a perspective view, a top plan view, a side elevation view, and a bottom plan view of the actuator of the present invention
Figure 2B:
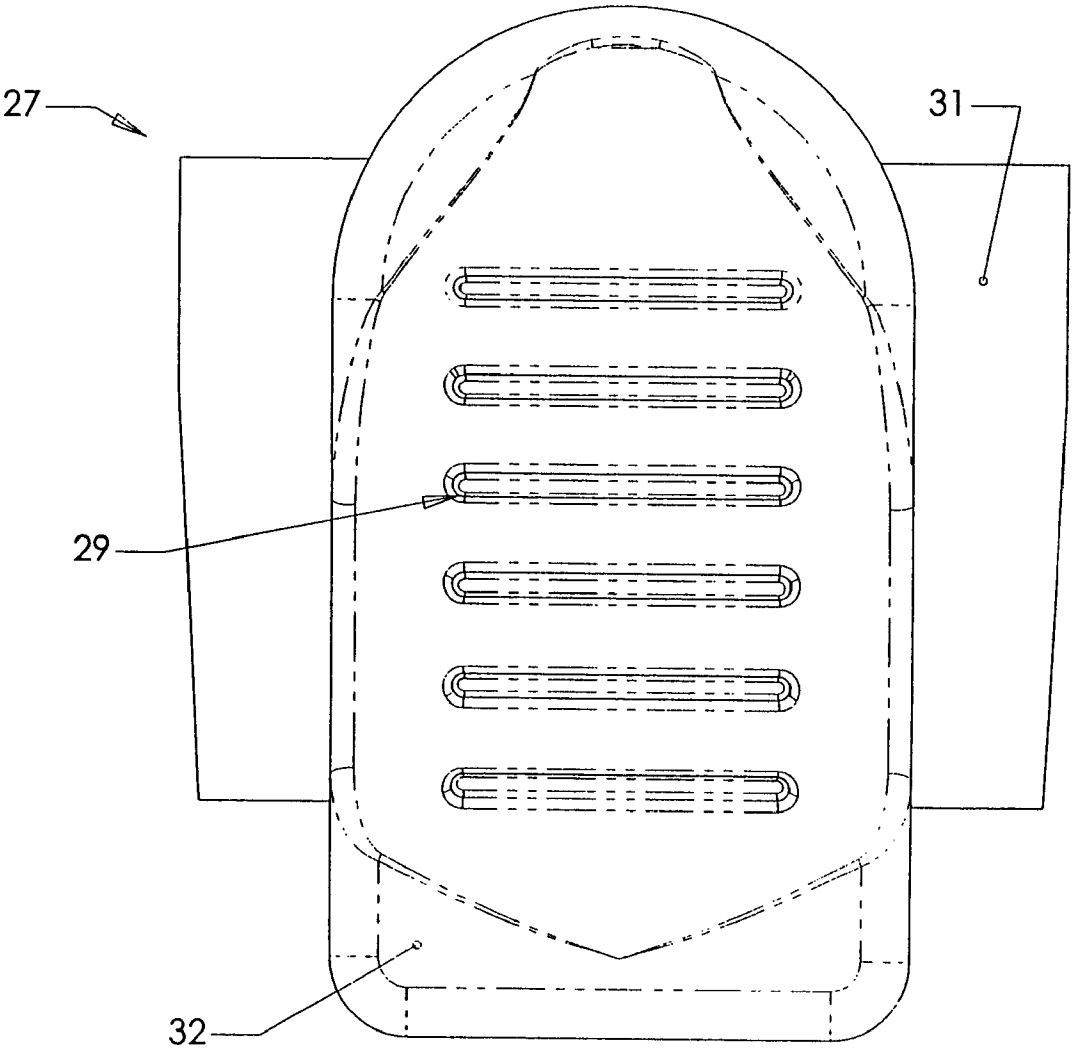
Figure 2C:
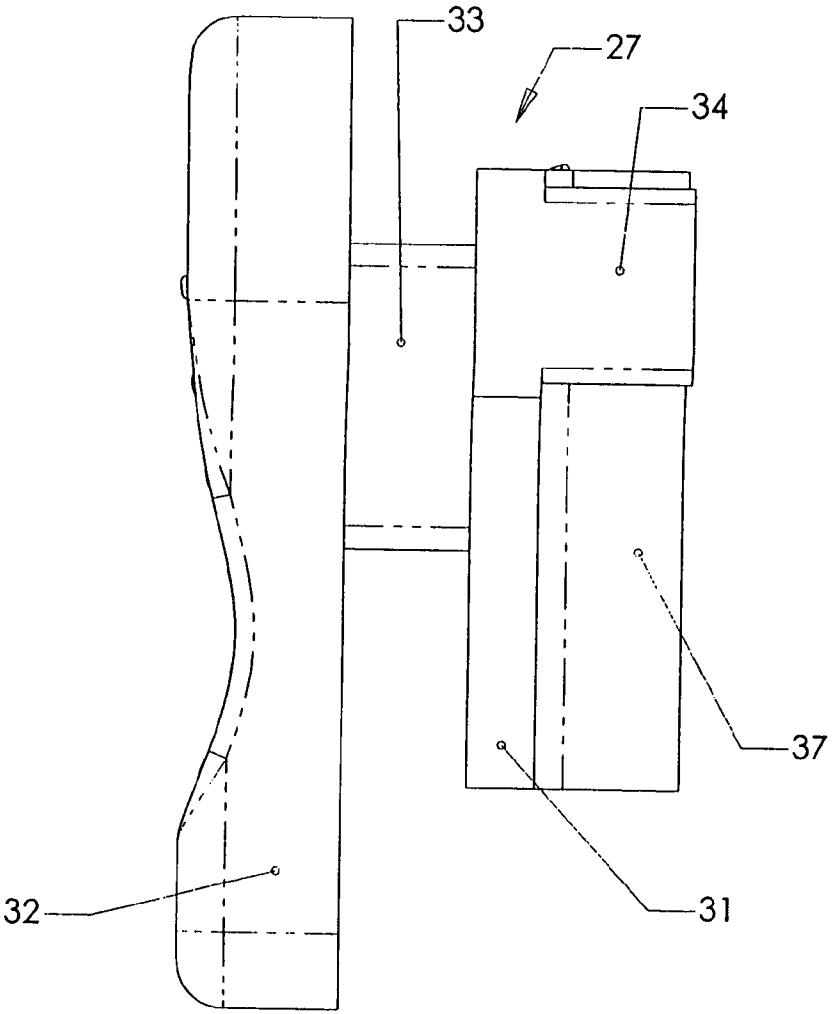
Figure 2D:
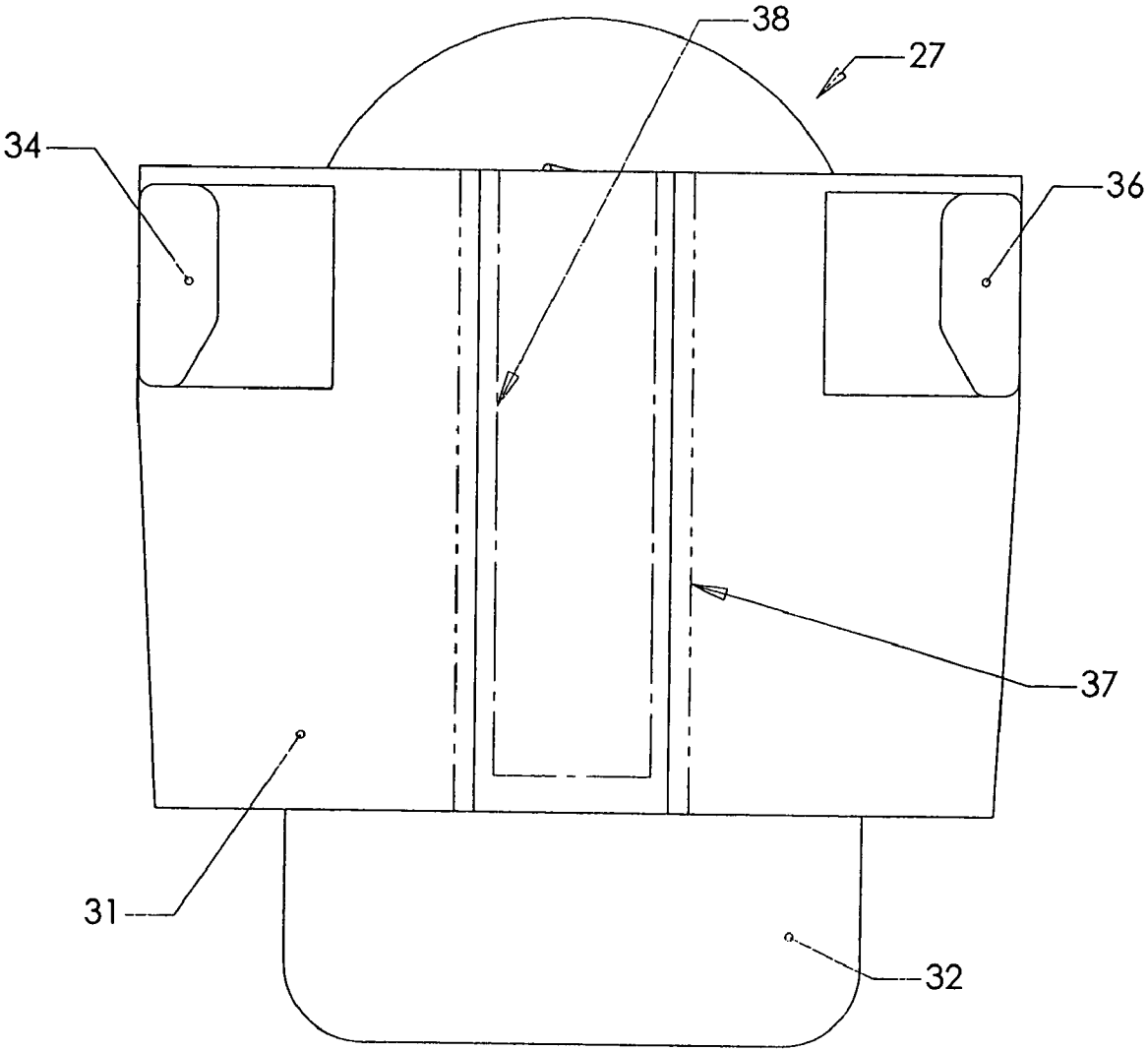

FIGS. 1*a* and 1*b* are perspective views of the locking adapter 11 of the present invention, which comprises, in its assembled form a unitary, substantially hollow housing 12 having a closed end 13 and an open end 14 to which a cap 16 is affixed. Closed end 13 is configured as a female receptacle, having first and second male plug blade receiving openings 17 and 18, an opening 19 for receiving a grounding pin, and a bolt hole 21 for receiving an assembly bolt, not shown, for attaching the cap 16 to the housing 12, as will be discussed hereinafter. The cap end or open end 14 of the adapter has cap 16 affixed thereto, from which protrude male plug blades 22 and 23, and a grounding pin 24. It is to be understood that openings 17 and 18 and blades 22 and 23 may be polarized, wherein one blade (blade 23 in FIG. 11*b*) is larger than the other being the "hot" blade. Also protruding from cap 16 is a grounding pin 24. Thus end 14 with cap 16 is configured as a male plug.

Slidably mounted on a wall 26 of housing 12 is an actuator 27 which, as will be seen later, protrudes into the interior of housing 12. Wall 26 has a slot 28 within which actuator 27 is carried and which allows actuator 27, which has a striated or knurled surface 29 to be moved longitudinally back and forth between ends 13 and 14 of the housing. As will be more apparent hereinafter, when actuator 27 is at the limit of its travel toward end 13, as shown in FIGS. 1*a* and 1*b*, as shown in FIGS. 1*a* and 1*b*, the adapter 11 is in the locked position. Conversely, when it is at the limit of its travel toward end 14 (and cap 16), the adapter 11 is in the unlocked position.

FIGS. 2*a*, 2*b*, 2*c*, and 2*d* are respectively perspective view, a top plan view, a side elevation view, and a bottom plan view of the actuator 27, which comprises a flat plate 31 joined to the top portion 32 by an alignment extension 33 which has a width slightly less than slot 28 to permit the actuator 27 to be moved longitudinally therein. Depending from the underside of plate 31 are first and second spaced actuating lugs 34 and 36 and a coiled spring receptacle 37 and a coiled spring receptacle 37 having a spring receiving hole 38 extending part way therethrough, as best seen in the dashed lines in FIG. 2*d*. It can be seen that hole 38 bottoms within receptacle 37. A coil spring 40 is configured within hole 38.

Figure 3A:
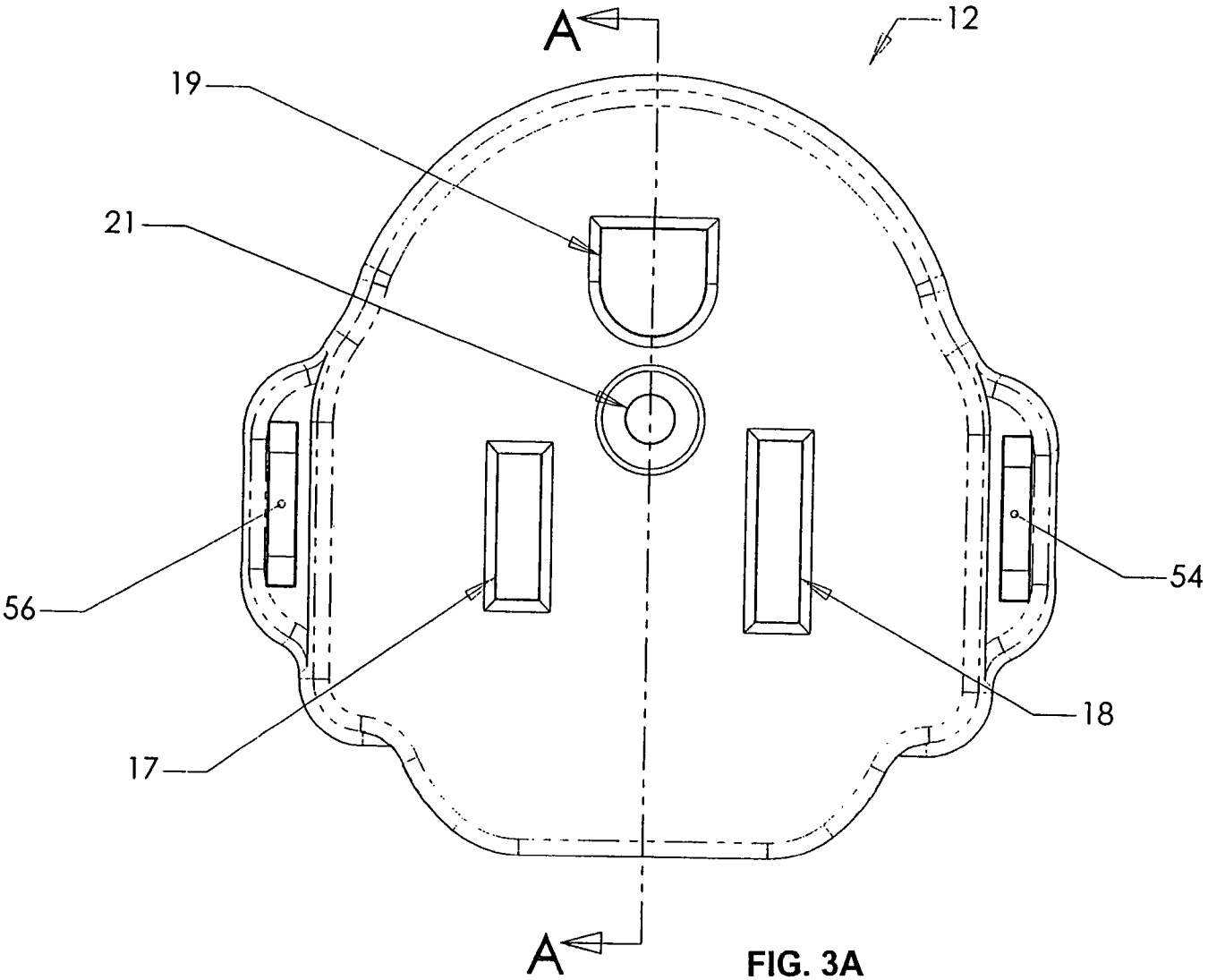
FIGS. 3*a*, 3*b*, and 3*c* are, respectively, an end elevation view, a side elevation view in cross section, and an elevation view of the interior face of the adapter housing of the invention
Figure 3B:
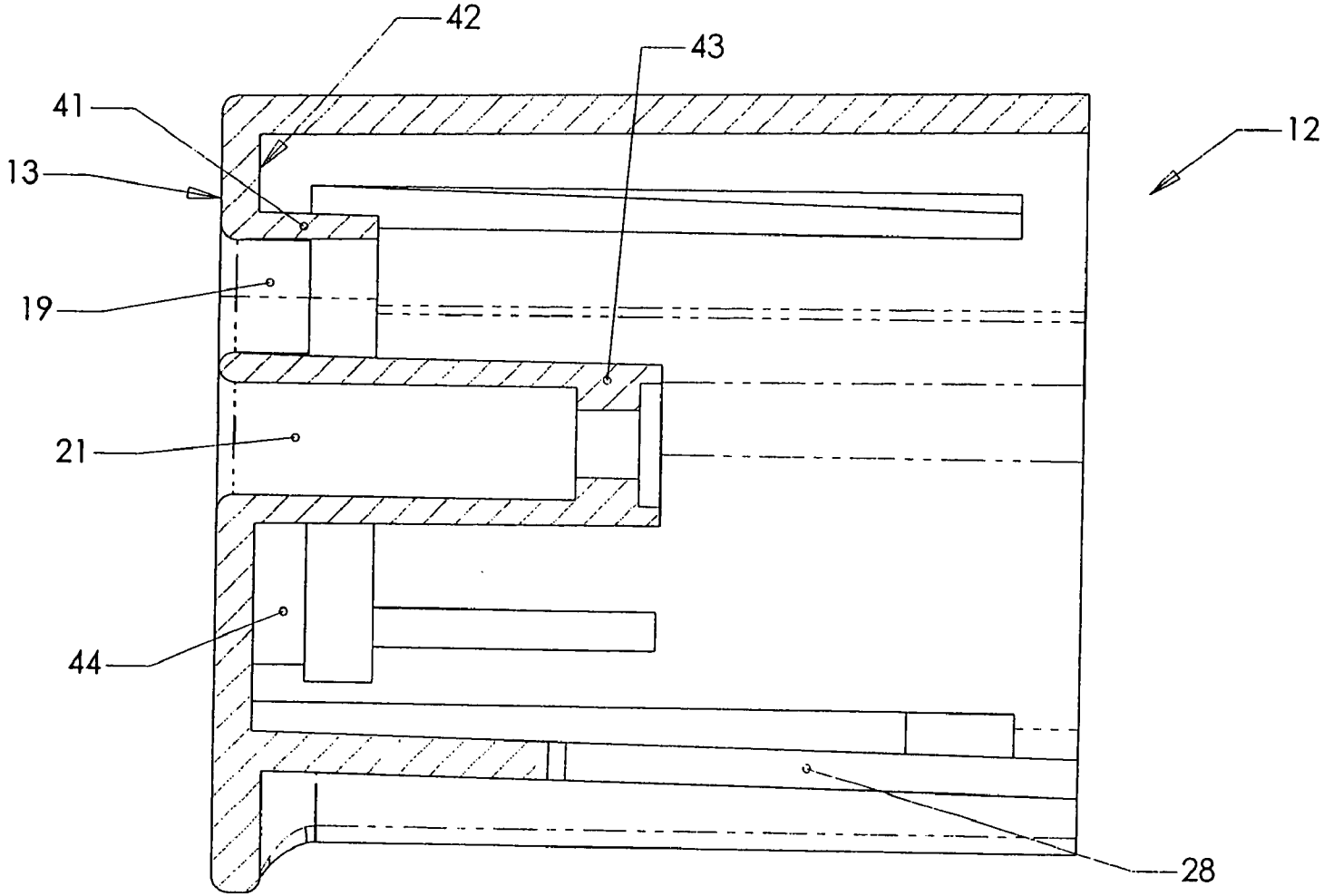
Figure 3C:
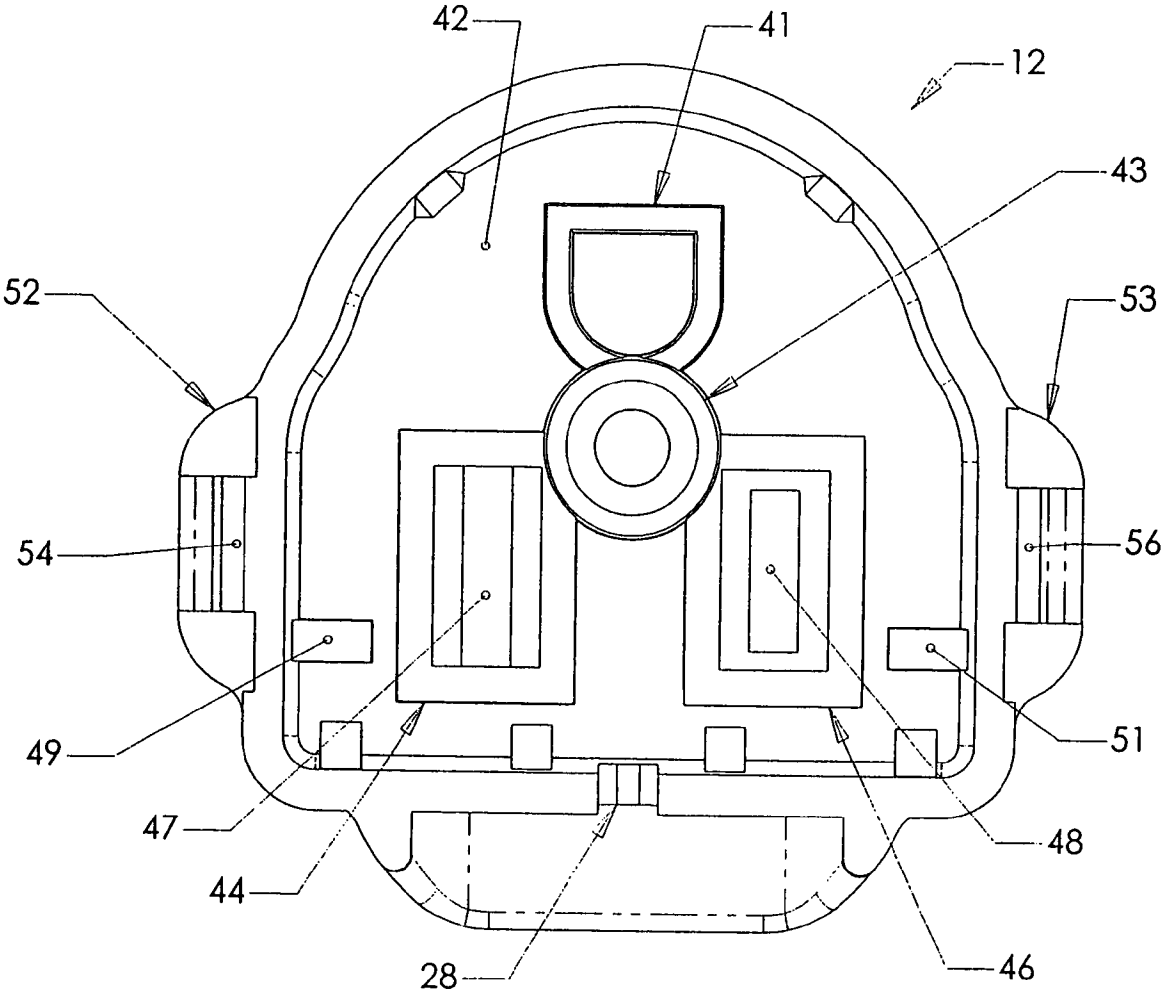

FIG. 3*a* is an elevation view of end 13 of housing 12, FIG. 3*b* is a side elevation view in cross section along the line A—A of housing 12 and FIG. 3*c* is an elevation view of that side of end 13 which faces the interior of housing 12. As best seen in FIGS. 3*b* and 3*c*, a holed boss 41 protrudes from the interior face 42 for supporting a grounding pin (not shown) of a male plug, also not shown. An elongated tubular member 43 extends from the interior face for receiving an assembly bolt as noted in the discussion of FIG. 1*a*. First and second rectangular bosses 44 and 46 having rectangular apertures 47 and 48 therein protrude from face 42 for locating and holding blades 22 and 23 of FIG. 1*b*, as will be discussed more fully hereinafter. It is to be understood that the two bosses 44 and 46 can be replaced by a single boss having two apertures 47 and 48 therein. Extending from each side wall of housing 12 is a planar shelf 49, 51 which function to support movable elements of the locking mechanism. From the side walls of housing 12 protrude first and second slotted members 52 and 53, having, respectively, slots 54 and 56 therein. Slotted member 53 is best seen in FIGS. 1*a* and 1*b*, and member 52, not shown therein, is identical thereto.

Figure 4A:
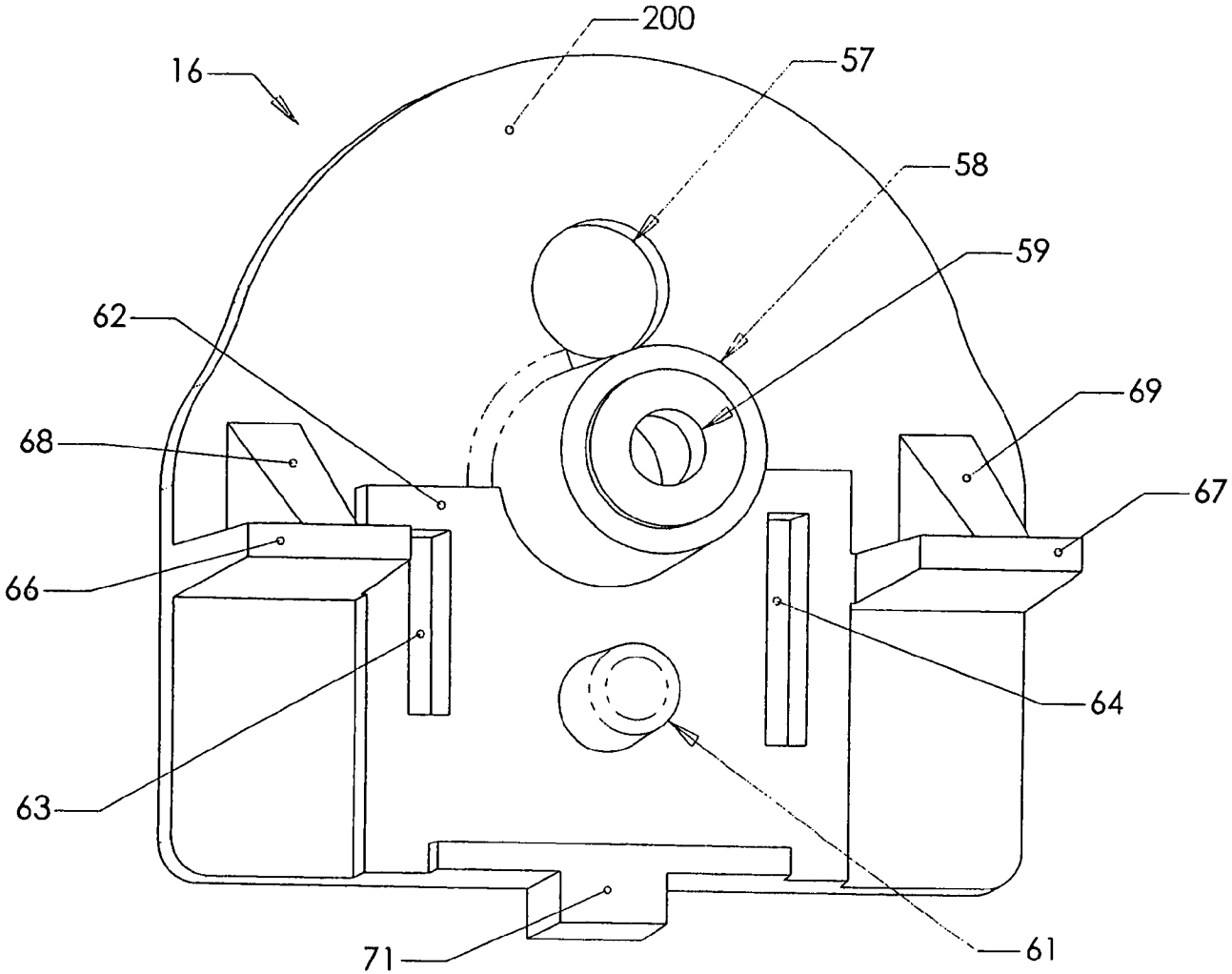
FIGS. 4*a* and 4*b* are, respectively, a perspective view and a side elevation view of the housing end cap of the invention.
Figure 4B:
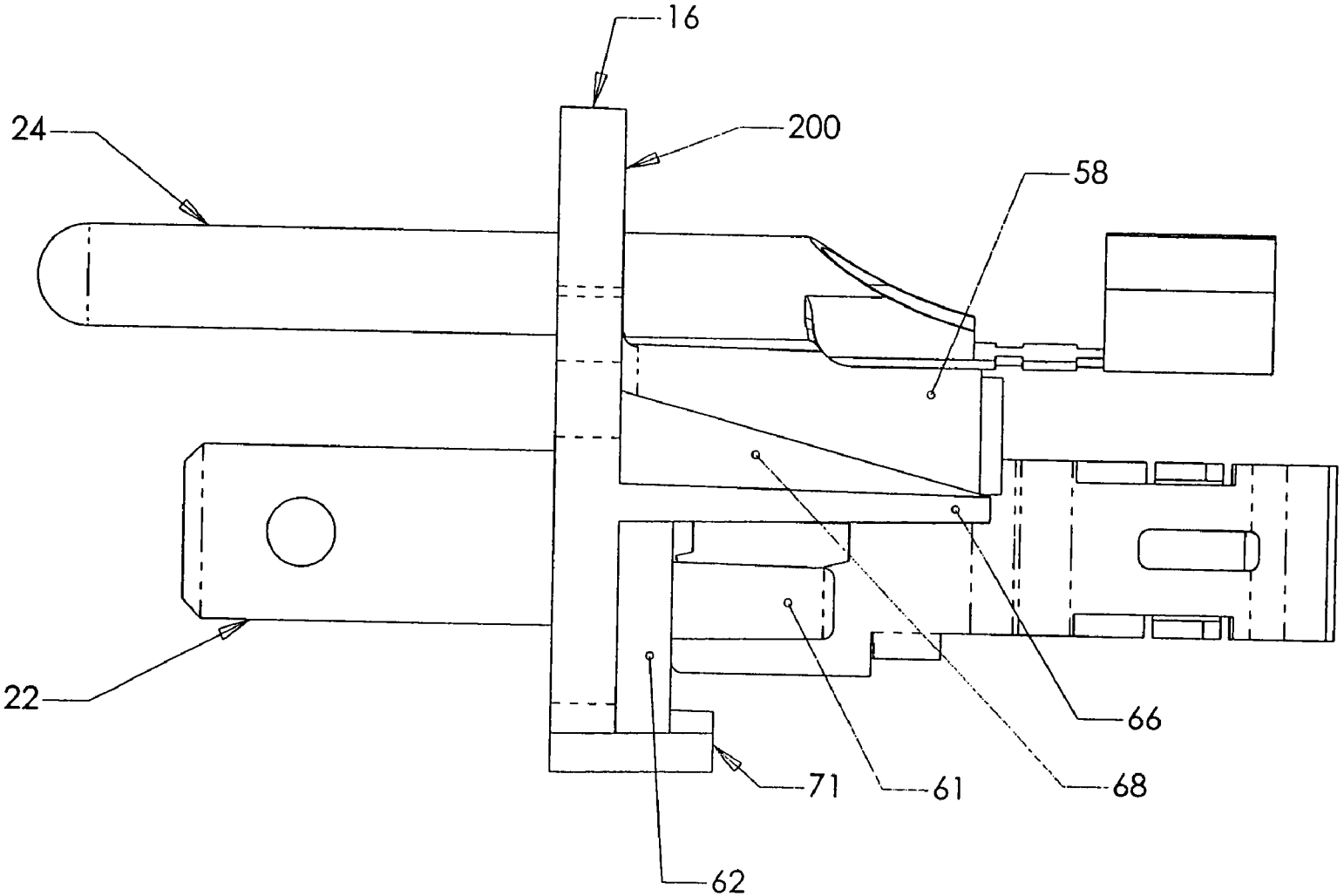

End cap 16 is depicted in FIG. 4*a*, which is a perspective view thereof, and FIG. 4*b*, which is a side elevation view thereof, with certain other elements shown in dashed lines, but numerically designated. As can best be seen in FIG. 4*a*, the wall of the cap has a hole 57 therein for receiving and holding grounding pin 24 which is, preferably, a tight fit therein. Extending from the wall into the interior of housing 12 is an elongated boss 58 having a bore 59 therein for receiving the assembly bolt, not shown.

Below boss 58 is a spring holding member 61 which holds and aligns spring 40 may be, as shown, a bored boss, or a simple protruding pin. A unitary boss 62 has slotted openings 63 and 64 for holding and allowing passage of 22 and 23 therethrough. If desired, boss 62 may comprise two separate slotted bosses, although molding or forming end cap 16, which is of insulating, stiff plastic, as is housing 12, may be simply where boss 62 is a unitary member having two slots 63 and 64 therein. First and second planar locating members 66 and 67 extending from the wall and are strengthened by ribs 68 and 69. As will be apparent hereinafter, these members 66 and 67 function to align and maintain such alignment of elements of the locking mechanism. Along the bottom edge of cap 16 is a stop member 71 which is dimensioned to fit within the end of slot 28, as an be seen in FIG. 1*b*, which functions to limit the movement of actuator 27 toward the caps end 14 of housing 12, and to retain the actuator 27 within its slot 28.

Figure 5:
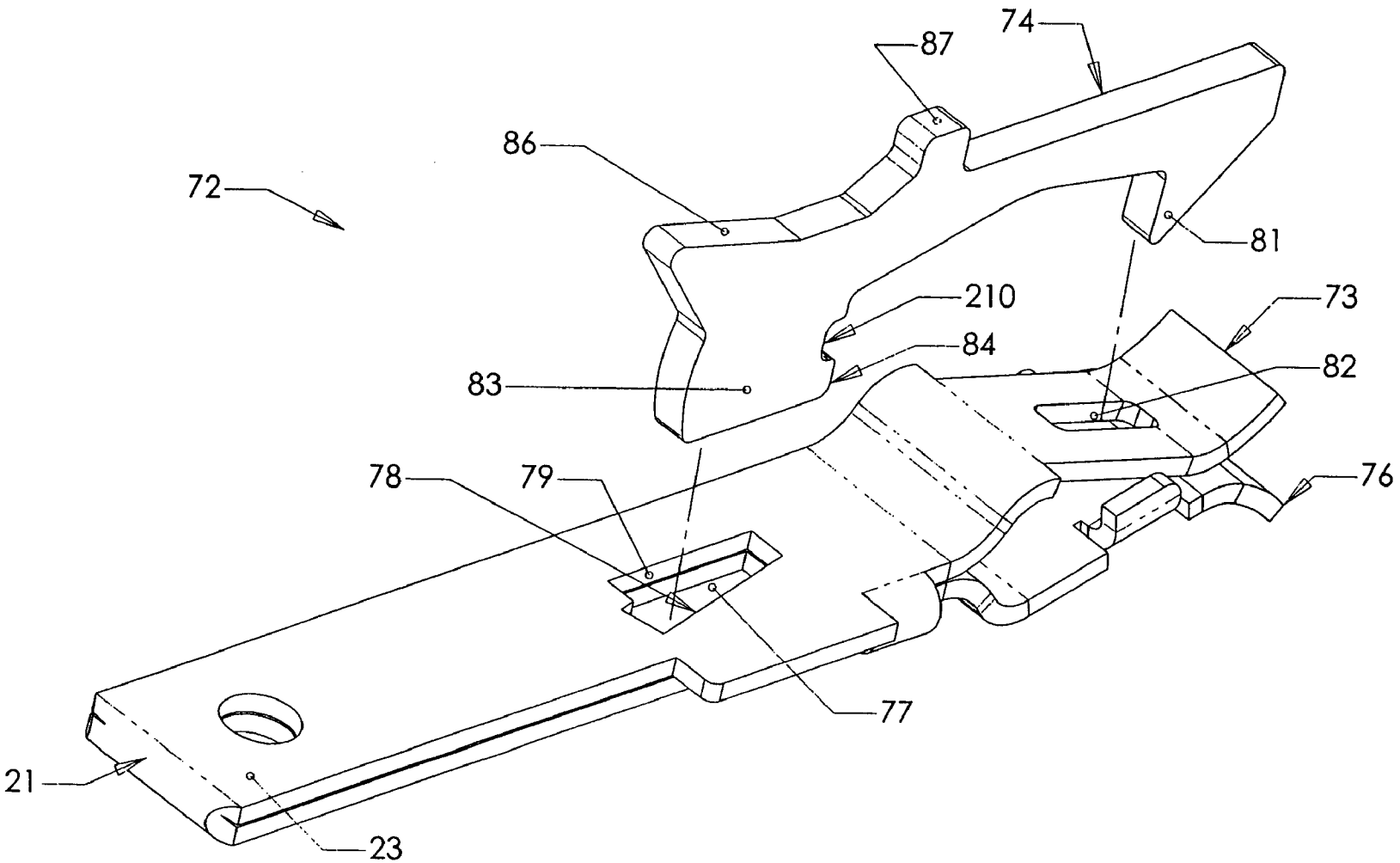
FIG. 5 is an exploded perspective view of a portion of the locking mechanism of the present invention.

A portion of the locking mechanism 72 is shown in FIG. 5. Mechanism 72 comprises a male plug blade receiving member 73 and a pivotable locking member 74. As will be apparent hereinafter, there are two such locking assemblies as shown in FIG. 5. Blade receiving member 73 which is made of suitable metallic material has a flared proximal end 76 which is dimensioned to fit within opening 47 or 48 in housing 12, which is dimensioned to allow end 76 to spread apart to receive a male blade and, through the natural spring action of member 73, to grip it. The distal end 21 of member 73 passed through slot 63 or 64 in cap 16 and contributes one blade 23 of a male plug configuration, as shown in FIGS. 1*a* and 1*b*. Approximately midway of member 72 is an opening 77 which has an angular portion 78 and a straight portion 79. Angular portion 78 has a slightly greater length than straight portion 79. Pivotal locking member 74 has a barb 81 on one end thereof which is adapted to fit within an opening 82 in end 76 of member 73. The end opposite barb 81 has a mounting lug 83 having a length slightly less than the length of the angular part 78 but greater than the length of straight opening 79, made so by a small projection 84 thereon. Thus, in mounting locking member 74 to member 73, the lug 83 is oriented to pass through angular opening 78 and then the member 74 is twisted to align lug 83 with the straight opening 79, with projection 84 on the side of member 73 opposite member 74. Mounted in this way, member 74 is pivotably mounted to move in a plane perpendicular to the surface plane of member 73, as indicated by the arrows, without escaping or otherwise disconnecting with member 73. At the rear of the top of member 74, the edge thereof has a sloping ramp 86 which, as will be apparent hereinafter functions as a camming surface for lug 34 or 36 of actuator 27. A stop member 87 projects upward from the top edge of member 74.

Figure 6A:
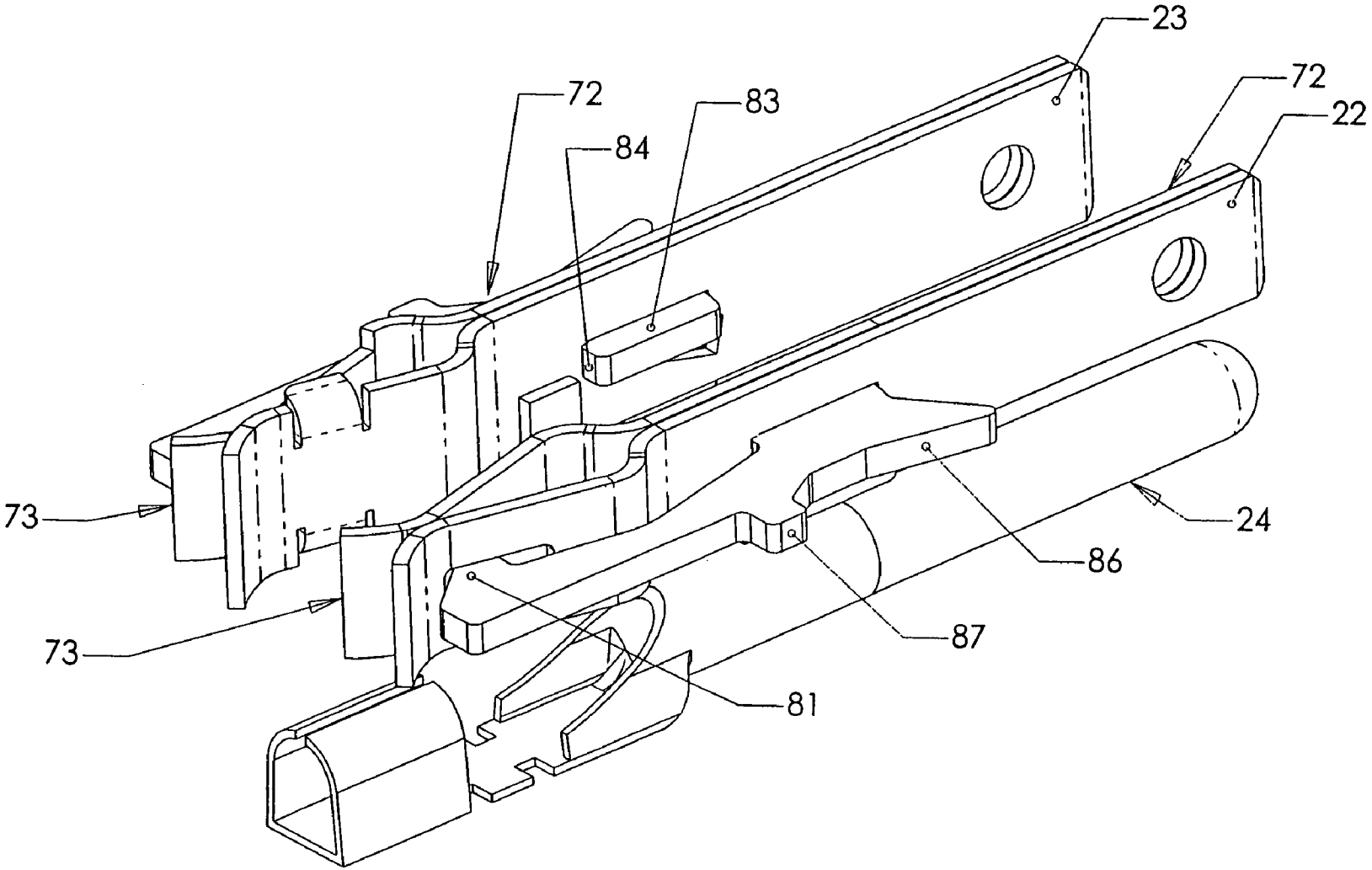
FIGS. 6*a*, 6*b*, and 6*c*, are perspective views of the locking mechanism of the present invention
Figure 6B:
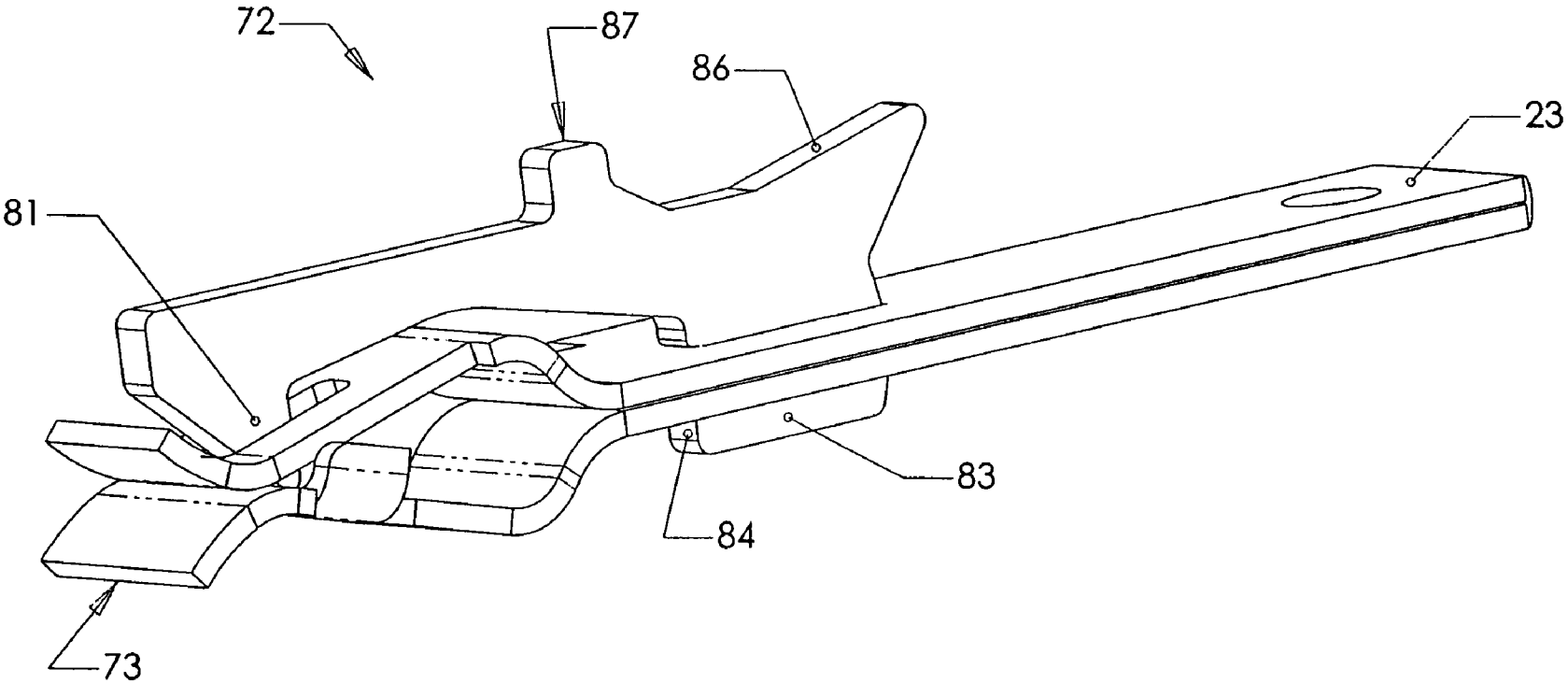
Figure 6C:
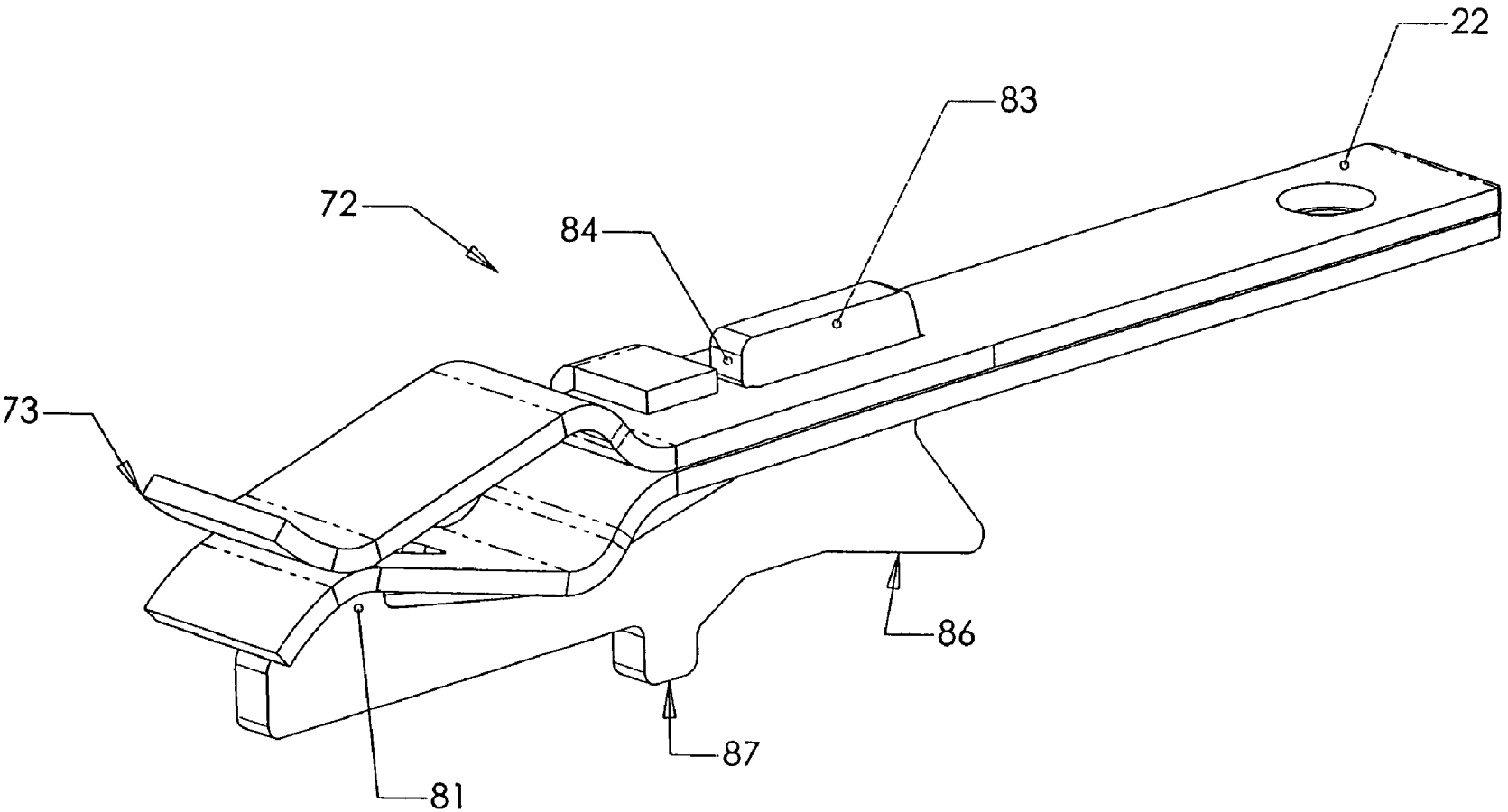

FIGS. 6*a*, 6*b*, and 6*c* are various perspective views of the assembled locking mechanism, with, in each view, the member 74 in its locking position where the barb 81 is within the opening 82 and, in the presence of a male blade, penetrates the hole therein to lock the blade within blade receiving member 73.

Figure 7:
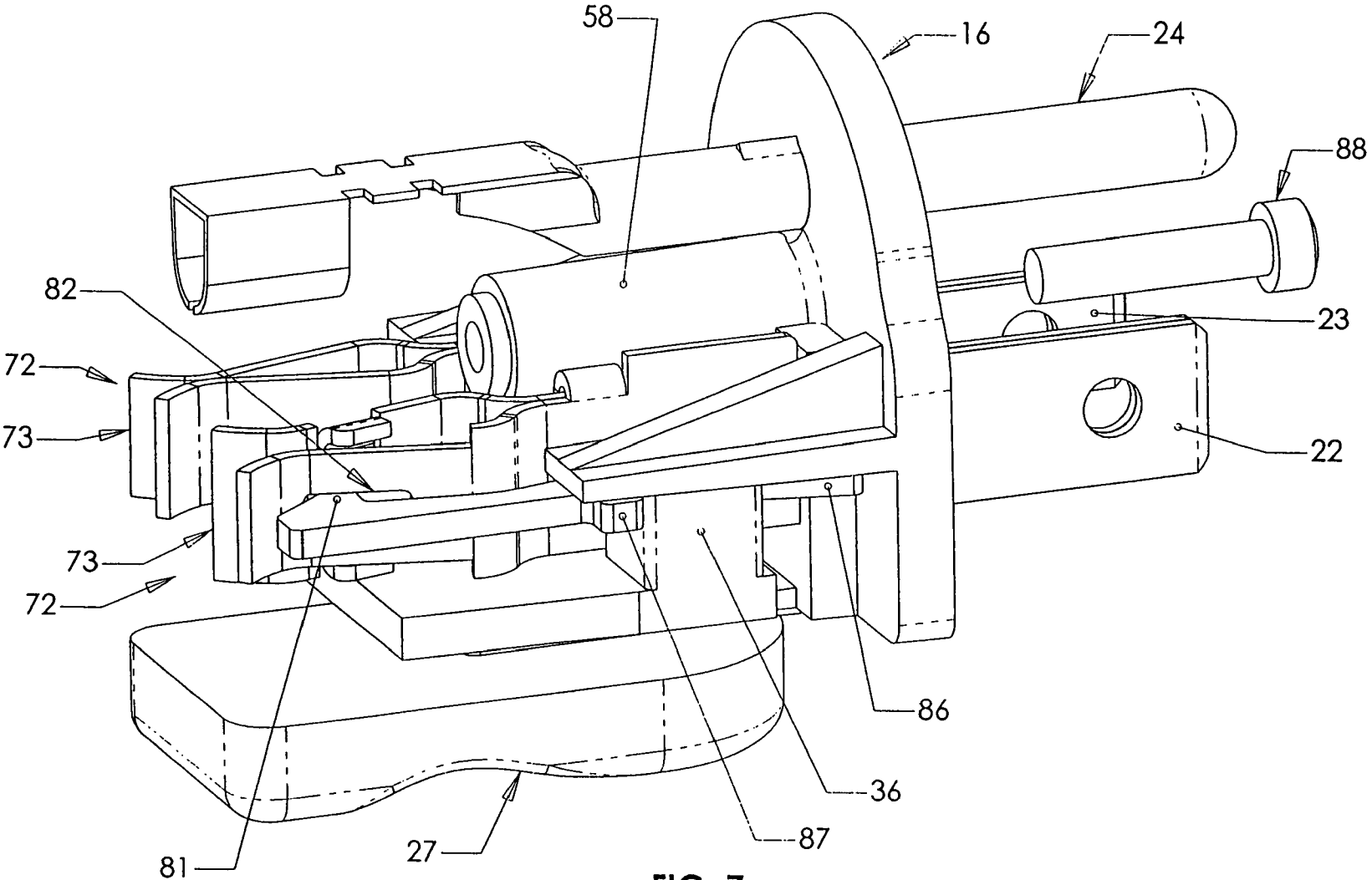
FIG. 7 is a perspective view of the locking mechanism and actuator assembled to the end cap.

The assembly of the cap 16, the locking mechanisms 72 and the position of the actuator 27 in the locking position, where the spring 40 forces the lug 36 against stop member 87, is shown in perspective in FIG. 7.

Figure 8:
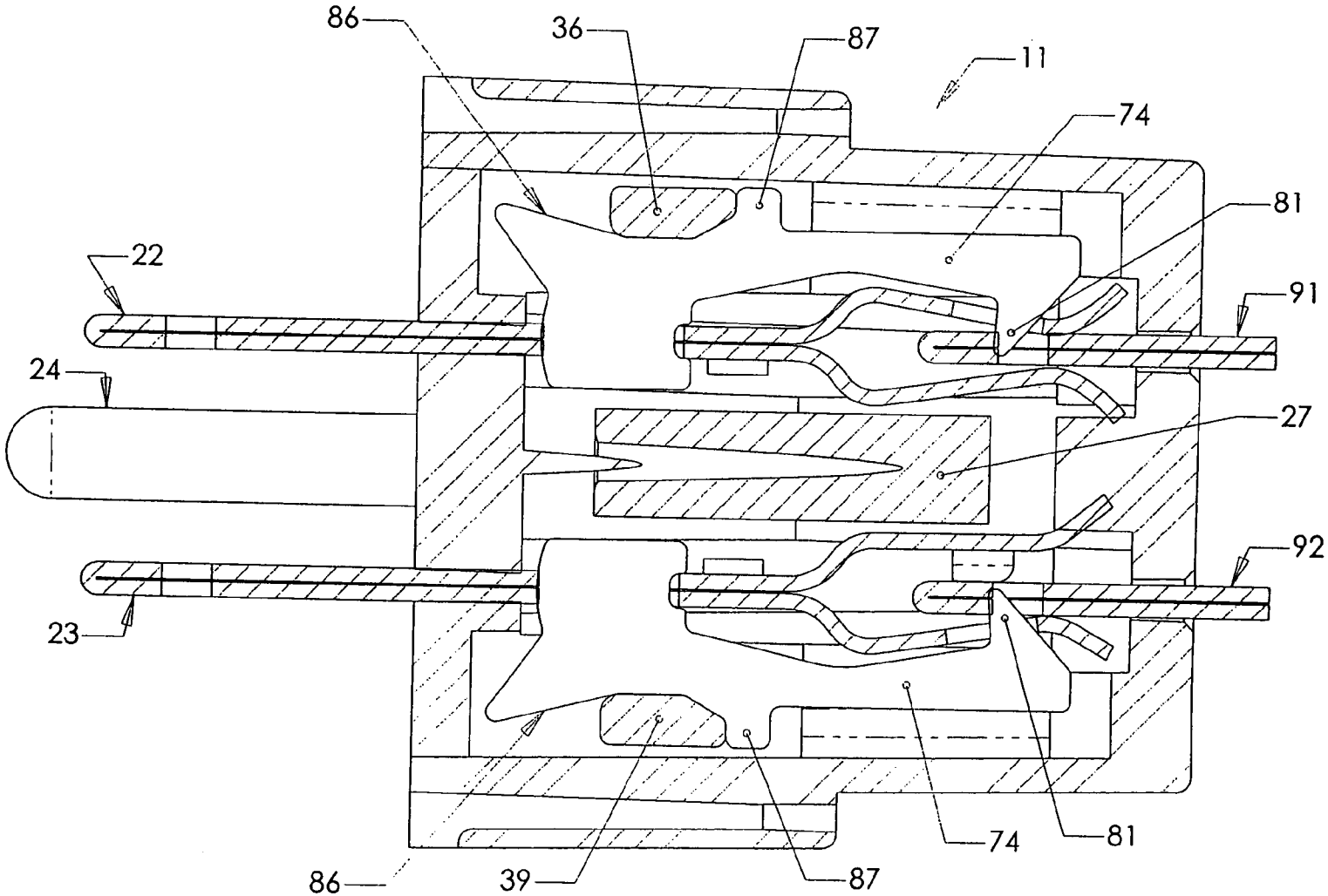
FIG. 8 is a top plan cross-sectional view of the locking mechanism within the housing in its locked configuration.

FIG. 8 is a top plan view in cross-section showing the action of the actuator to maintain or lock the blades 91 and 92 of a male plug within adapter 11. The spring 40 applies a force to actuator 27 to cause the lugs 34 and 36 to press against stop member 87, thereby preventing member 74 from pivoting and thus maintaining barbs 81 in the holes in blades 91 and 92, locking them in place.

Figure 9:
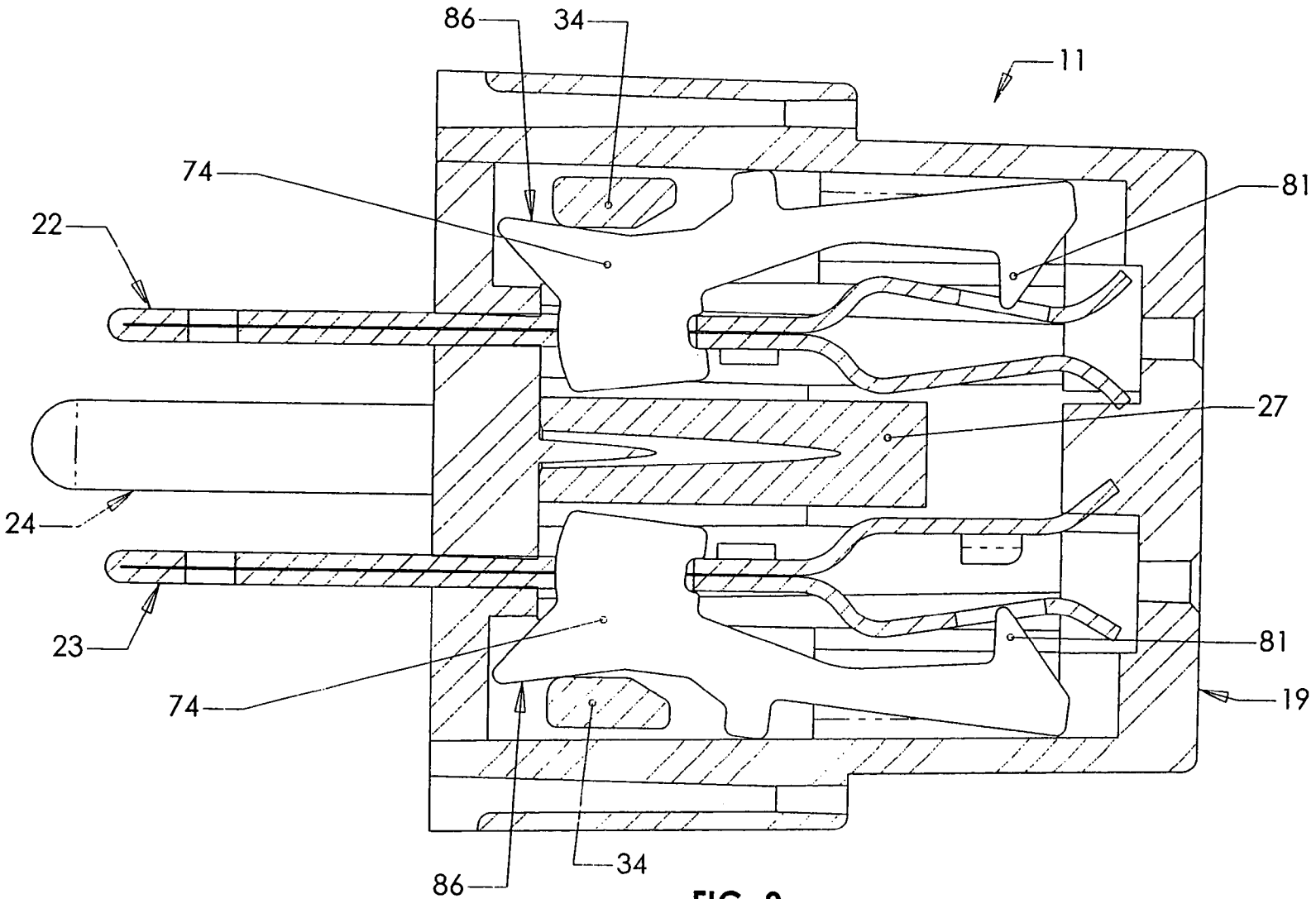
FIG. 9 is a top plan cross-sectional view of the locking mechanism within the housing in its unlocked or release position.

In FIG. 9 the actuator 27 has been moved (to the right in the figure) and the lugs 34 ride up ramp 86, thereby depressing that end of the locking member 74, causing it to pivot and thereby raising barbs 81 to an unlocked position, enabling disconnect from the male plug (not shown).

Figure 10:
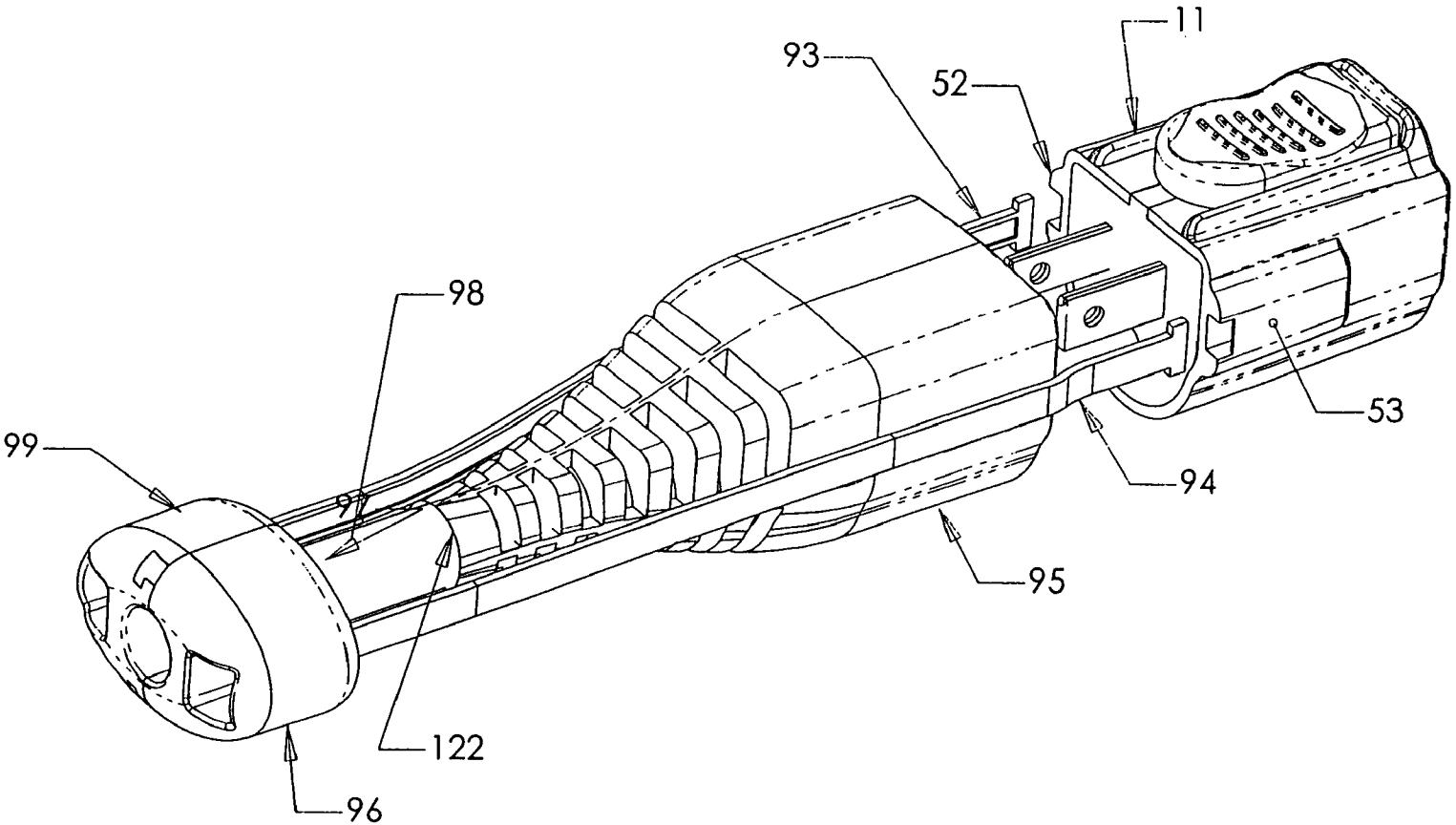
FIG. 10 is a plan view of the one arrangement for fixing the adapter to a female cord termination.

The power supply cord conventionally is terminated in a female receptacle to which the adapter 11 of the present invention is connected by means of blades 22 and 23 and grounding member 24. The other end 13 of the adapter 11 receives the male plug of the cord from the apparatus. As a consequence, it is desirable to affix the adapter to the power cord female connector. There is shown in FIG. 10 an embodiment of the invention wherein the adapter 11 is strapped to a female termination 95 of the power cord. In the arrangement of FIG. 10 first and second strap 93 and 94 preferably of flexible plastic and having striated surfaces, are affixed slotted members 52 and 53 and extend behind the female member 95 to a split collar 96 having therewithin a split sleeve 97 surrounding the power cable 98. The straps 93 and 94 pass between the opening in collar 96, shown in dashed lines, and sleeve 97. Sleeve 97 pushed up against the end of strain relief of female connector 95 and collar 96 is tightened by means of bolt 99, thereby affixing the straps to the collar/sleeve assembly. Thus, adapter 11 is firmly held in place connected with female member 95 and cannot disconnect. It is to be understood that the split sleeve/collar arrangement is only one of several possible ways to affix the straps 93 and 94.

Figure 11:
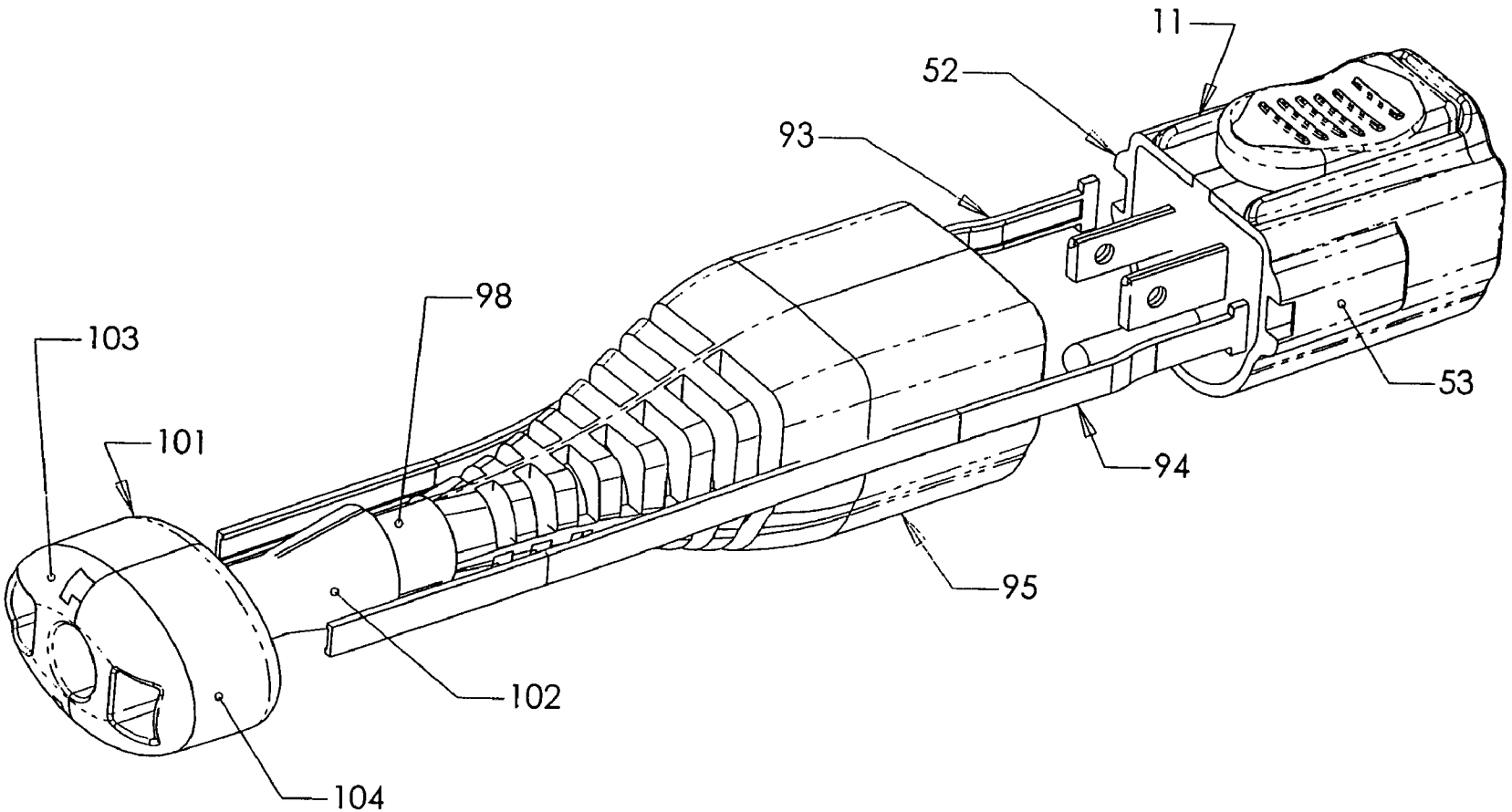
FIG. 11 is a variant of the arrangement of FIG. 10 which utilizes a novel collar arrangement.
Figure 14:
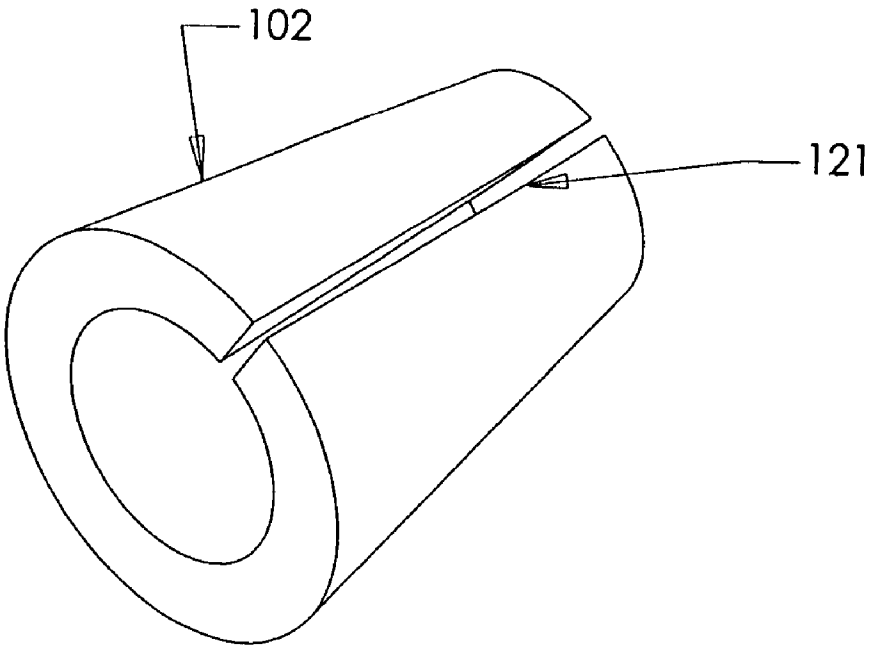
FIG. 14 is a perspective view of a split tapered sleeve for use with the collar of FIGS. 11 and 13.

In FIG. 11 there is shown a variant of the arrangement of FIG. 10 in which a novel strap clamping collar 101 in used in conjunction with tapered split sleeve 102, which is best seen in FIG. 14. Clamping collar 101 has first and second portions 103 and 104 to form a complete collar surrounding sleeve 102, as will be discussed hereinafter.

Figure 12:
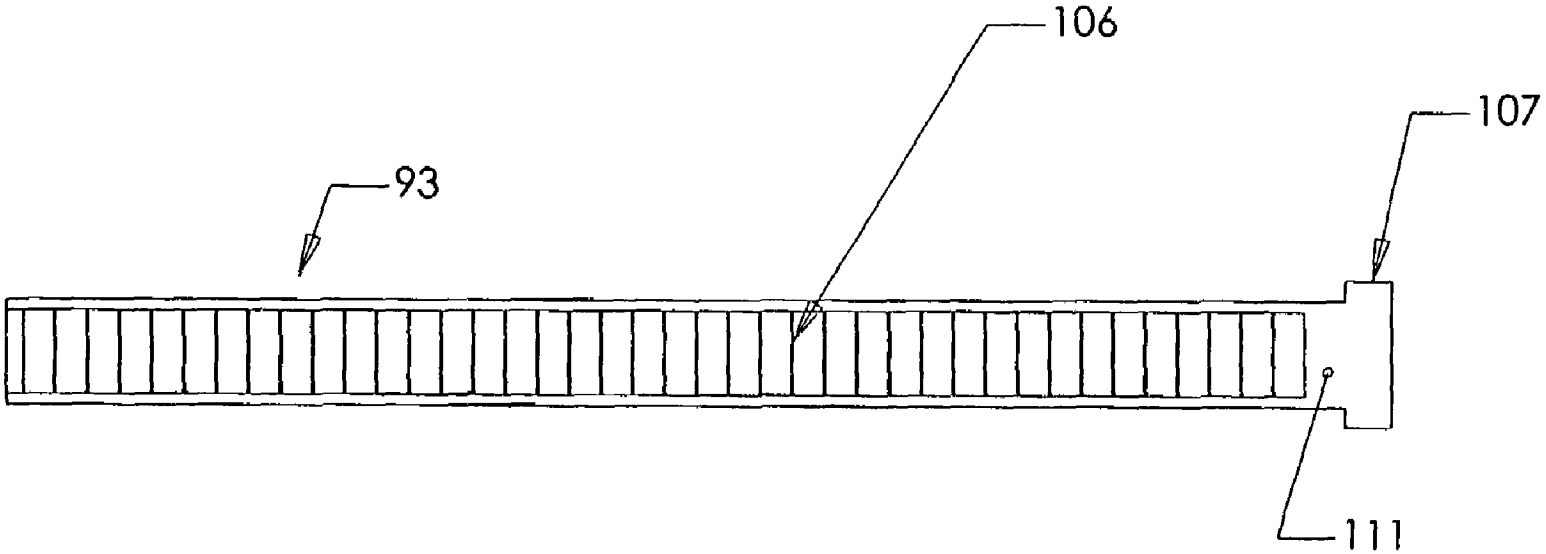
FIG. 12 is a plan view of a strap as used in the arrangement of FIGS. 10 and 11.
Figure 13A:
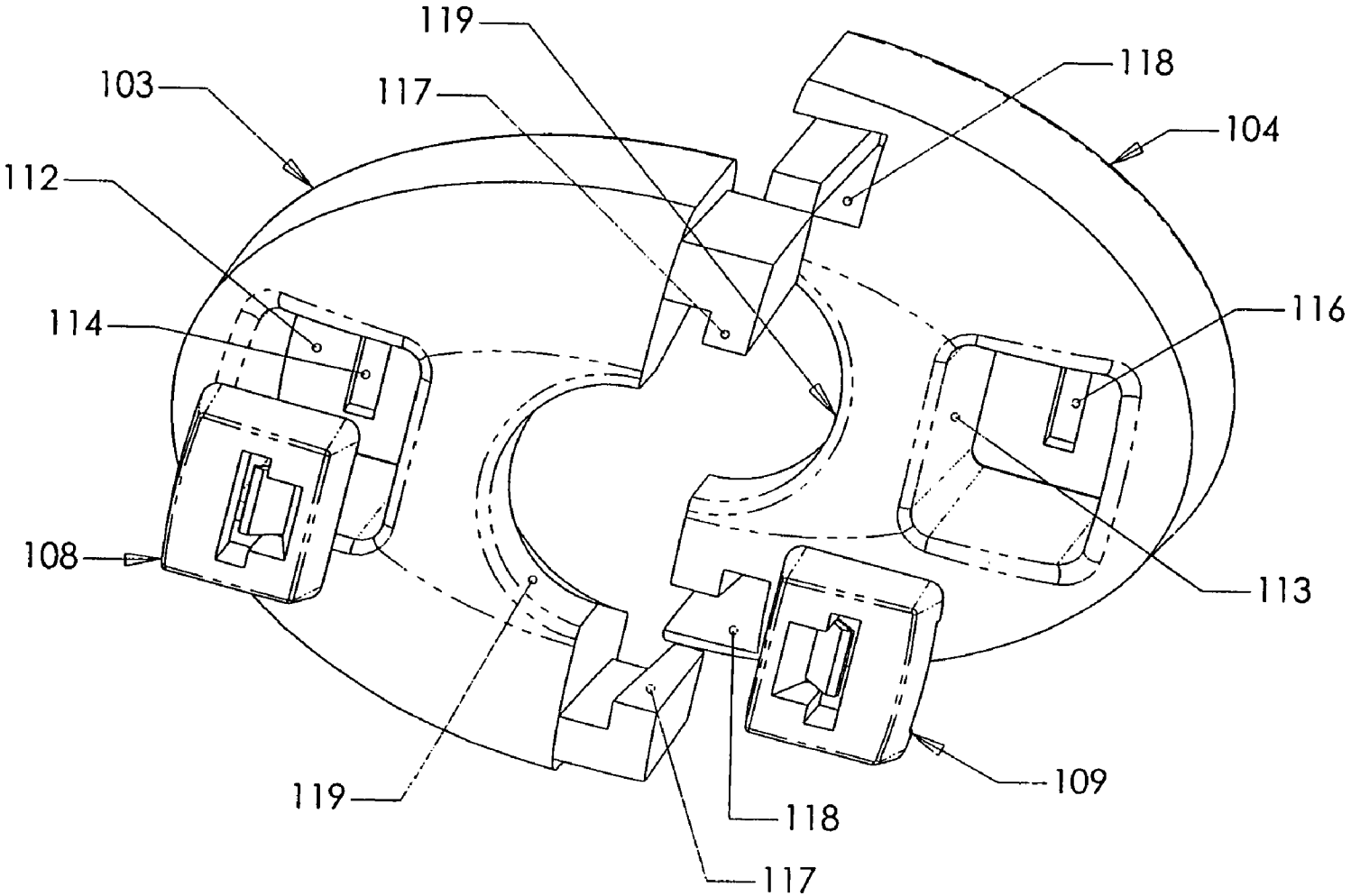
FIGS. 13(*a*) and 13(*b*) are perspective views of the novel collar of FIG. 11.
Figure 13B:
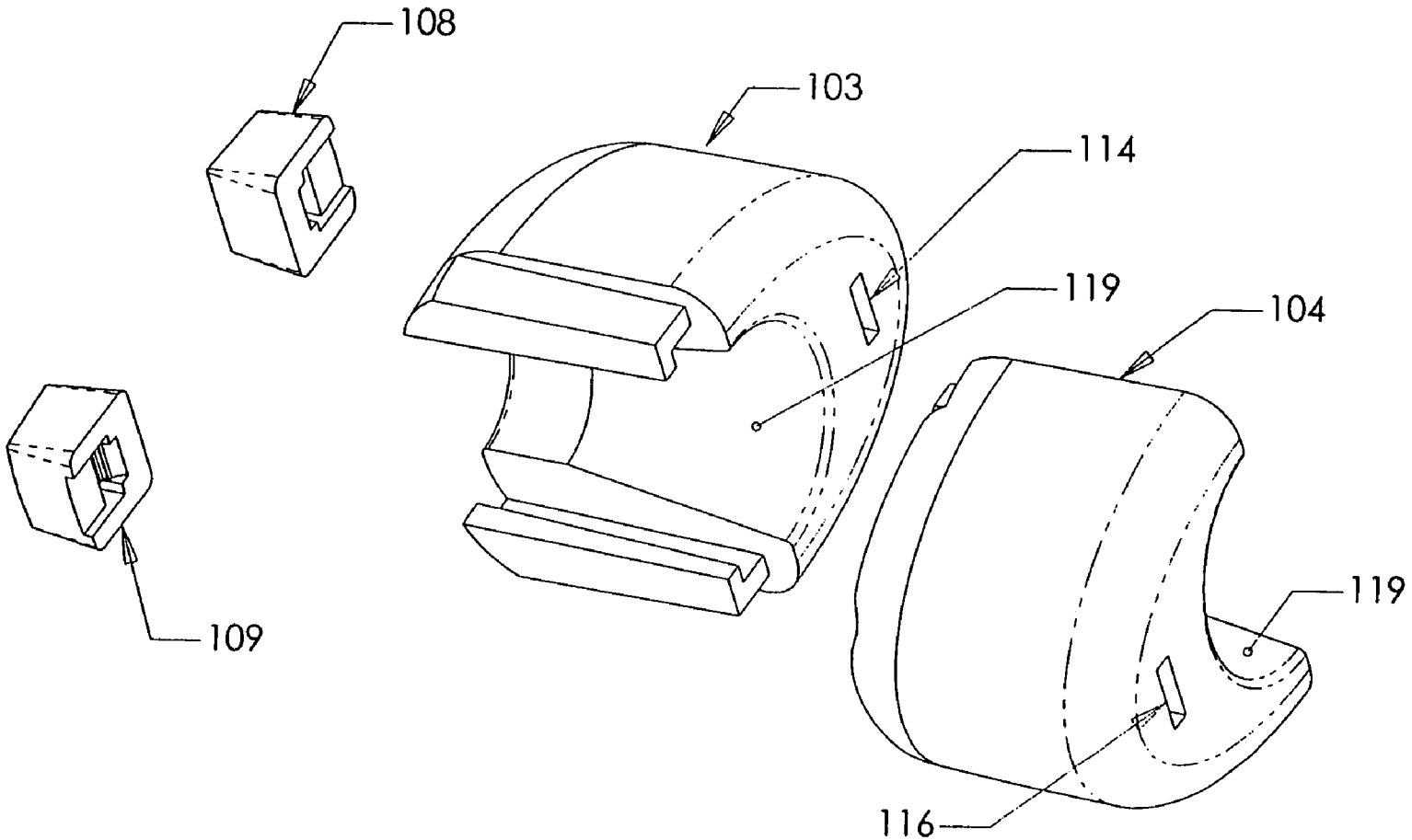

FIG. 12 is a plan view of the strap 93 to which strap 94 is identical. Such a strap, which is made of flexible plastic material, has an array of striations or grooves 106 and an enlarged end 107. The strap has a width such that it can pass through the slot in slotted member 52 and 53, but the width of the end 107 of the strap cannot pass through the slot in members 52 or 53, and thus prevents the strap from being pulled out of member 52 or 53. Such straps are commercially available and have, at the end opposite the enlarged end, and attached thereto, a locking member 108 or 109, which are shown in FIGS. 13*a* and 13*b*, removed from the end of the strap. In the commercial configuration enlarged end 107 is not present, and the strap 93 has a distal end 11. When the distal end 111 is inserted in the locking member 108 at its other end, it can be pulled therethrough, but it cannot be withdrawn. Thus the strap can be used to bind wires or other elongated materials together. In FIGS. 13*a* and 13*b*, each of the members 103 and 104 has a pocket 112 or 113 therein which is dimensional to receive and hold a locking member 108 or 109. Each pocket 112, 113 has a slot 114, 116 to allow passage of strap 93 or 94 into and through the corresponding locking member 108, 109 contained in the pocket. For commercial consideration not shown, locking member and pocket can be molded and manufactured as one piece into halves of 103 and 104 of collar 101. Members 103 and 104 are keyed together by a suitable key 117 and keyway 118 arrangement, as best seen in FIG. 13*a*. When keyed together, members 103 and 104 have a tapered bore 119, which, as shown in FIG. 11, surrounds a tapered sleeve 102, which has a split 121, as shown in FIG. 14. Sleeve 102 is preferably made of rubber or a compressible plastic material which, as sleeve 102 is forced into tapered bore 119, compresses to close split 121.

Figure 15:
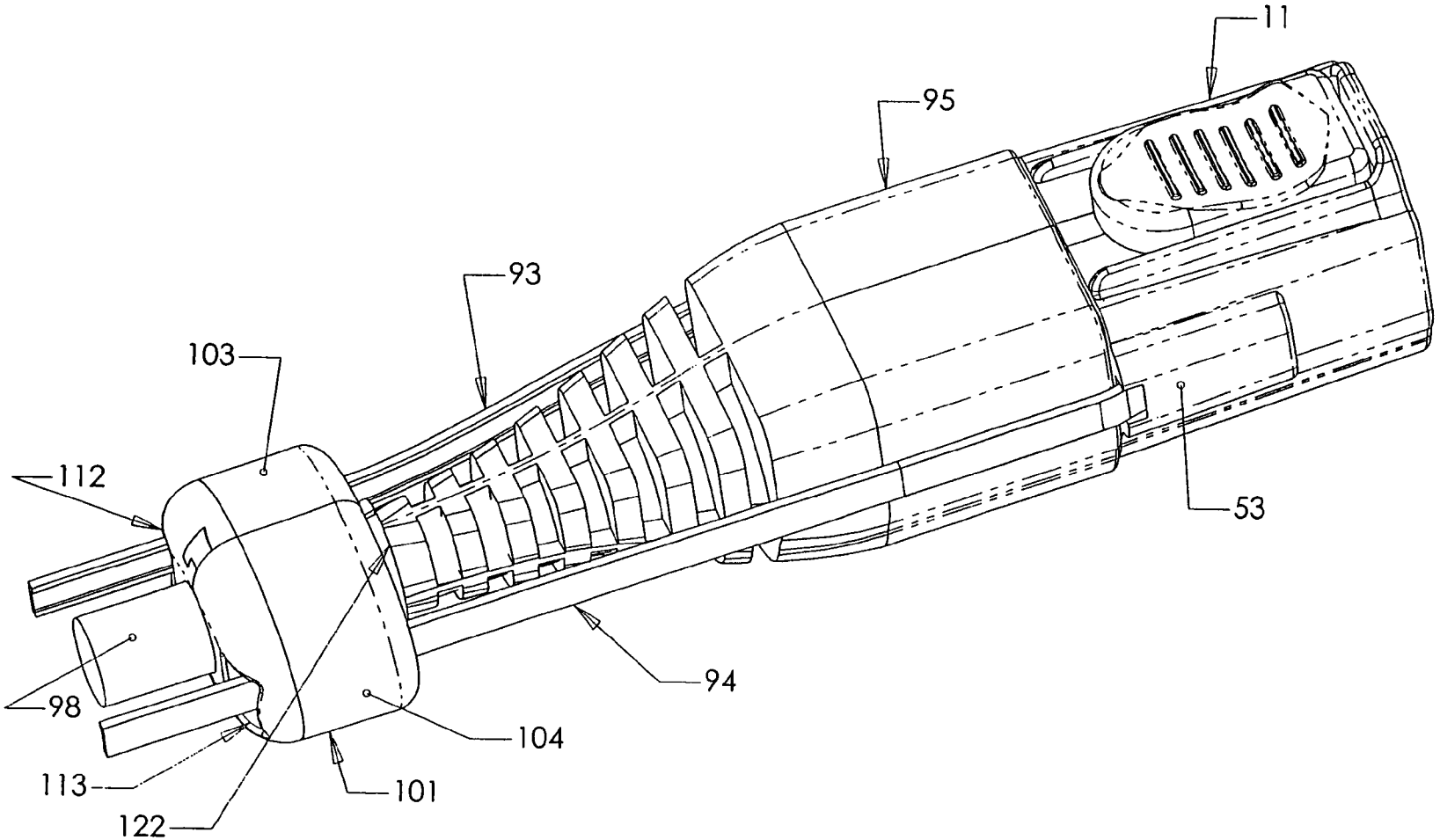
FIG. 15 is a perspective view of the arrangement of FIG. 11 in its locking or fixing configurations.

In FIG. 15 there is shown the manner in which adapter 11 is firmly attached to female member 95. As straps 93 and 94 are pulled through member 101, which is pushed forward until it and sleeve 102 bear tightly against the rear end of strain relief 122 of member 95, the straps are locked by members 108 and 109, and thus adapter 11 is firmly attached to female member 95 and cannot be removed except by cutting straps 93 and 94.

Figure 16:
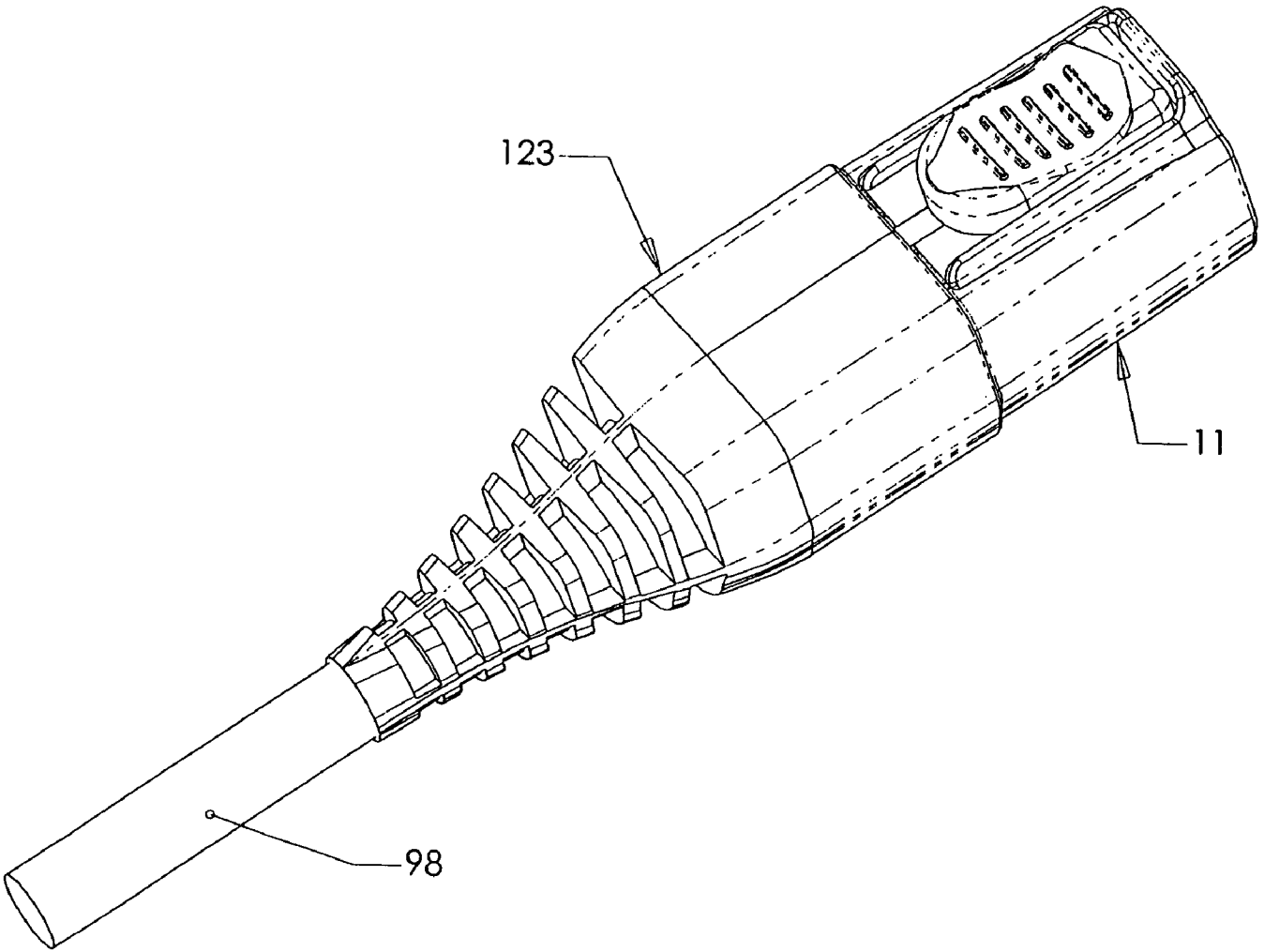
FIG. 16 is a perspective view of the adapter of the invention connected to a power cord and overmolded for fixing and protection.

In FIG. 16 there is shown an embodiment of the invention wherein adapter 11 constitutes the female termination of the power cable 98. In this embodiment, the standard female termination is removed and the bare wires are affixed to the male plug blades 22 and 23 and ground pin 24 as by soldering. The connection is then encapsulated within a plastic or, for example, rubber overmold 123.

The basic adapter of the present invention is amenable to other configurations such as a gang configuration of several side by side adapters having a plurality of female receptacles with only one male plug, as represented by the male plug blades 22 and 23 and grounding member 24. For example, the principles and features of the present invention may be readily adapted to continental, European, or other type plugs.

From the foregoing, it can be seen that the adapter is relatively quite simple, having only three moving parts, and can be easily assembled or disassembled.

It is to be understood that the various features of the present invention might be incorporated into other types of connector adapters, and that other modifications or adaptations might occur to workers in the art. All such variations and/or modifications are intended to be included herein as being within the scope of the present invention as set forth. Further, in the claims hereinafter, the corresponding structures, materials, acts, and equivalents of all means or step-plus-function elements are intended to include any structure, materials, or acts for performing the functions in combination with other elements as specifically claimed.

Therefore, having thus described the invention, at least the following is claimed:

1. For use in joining two members together, a locking assembly comprising:

at least one flexible strap mounted to one of said members;

a strap retaining member mounted to the other of said members;

said strap retaining member having first and second strap locking members mounted in pockets within said strap retaining member through which said straps pass; said strap retaining member comprsing first and second members keyed together to form said retaining member having a tapered bore therein surrounding a portion of the other of said members.

2. A locking assembly as claimed in claim 1 wherein said bore is tapered.

3. A locking assembly as claimed in claim 1 and further comprising a split sleeve member adapted to fit within said bore.

4. A locking assembly as claimed in claim 3 wherein said split sleeve is tapered.

5. A locking assembly for locking a power cord adapter to an end of a power cord comprising:

at least one flexible strap adapted to be affixed to the power cord assembly;

a strap retaining member adapted to be fixed to the power cord, said strap retaining member having at least one strap locking member through which said strap passes;

said locking member being adapted to maintain said strap under tension whereby the power cord adapter is locked to the end of the power cord;

said strap retaining member comprising a split collar having an axially extending bore, said split collar comprising a first arcuate member having at least one longitudinally extending keyway and a second arcuate member having a longitudinally extending key adapted to fit in said keyway to form a unitary strap retaining member, said first and second arcuate member forming said axially extending bore in said strap retaining member;

said axially extending bore being tapered.

6. A locking assembly as claimed in claim 5 and further comprising a split sleeve adapted to fit within said tapered bore.

7. A locking assembly for locking a power cord adapter to an end of a power cord comprising:

at least one flexible strap adapted to be affixed to the power cord adapter;

a strap retaining member adapted to be fixed to the power cord, said strap retaining member having at least one strap locking member through which said strap passes;

said locking member being adapted to maintain said strap under tension whereby the power cord adapter is locked to the end of the power cord;

said strap retaining member having at least one pocket therein wherein said strap locking member is mounted for permitting said strap to be pulled therethrough in one direction only.

8. A locking assembly as claimed in claim 7 wherein said one direction is from the cable end and along the length thereof.

9. A locking assembly for locking a power cord adapter to an end of a power cord comprising:

a collar member having a bore therein for mounting to the power cord;

a member for applying a tensile force between the power cord adapter and said collar comprising a flexible strap having attachment means for attaching an end thereof to the power cord adapter;

said collar member having a pocket therein through which said strap passes, said packet having a strap locking member therein;

said strap locking member being mounted in said pocket for permitting said strap to be pulled through said pocket in one direction only.

10. A locking assembly as claimed in claim 9 wherein said one direction is in the direction away from the power cord adapter.

11. A locking assembly for locking a power cord adapter to an end of a power cord comprising:

a collar member having a bore therein for mounting to the power cord;

a member for applying a tensile force between the power cord adapter and said collar comprising a flexible strap having attachment means for attaching an end thereof to the power cord adapter;

said collar member having a pocket therein through which said strap passes, said pocket having a strap locking member therein;

said bore in said collar member being tapered; and a tapered split sleeve member in said bore and surrounding the power cord.

* * * * *